US012227381B2

(12) United States Patent
Jonckers et al.

(10) Patent No.: US 12,227,381 B2
(45) Date of Patent: Feb. 18, 2025

(54) METHOD AND APPARATUS FOR DIVERTING AND/OR FOLDING ARTICLES

(71) Applicant: Amazon Technologies, Inc., Seattle, WA (US)

(72) Inventors: Jef Jonckers, Hamme (BE); Manu Peelman, Hamme (BE); Tom Van Moer, Hamme (BE); Philip Corens, Hamme (BE); Hilde Cloostermans, Hamme (BE)

(73) Assignee: Amazon Technologies, Inc., Seattle, WA (US)

( * ) Notice: Subject to any disclaimer, the term of this patent is extended or adjusted under 35 U.S.C. 154(b) by 344 days.

(21) Appl. No.: 17/638,965

(22) PCT Filed: Sep. 3, 2020

(86) PCT No.: PCT/EP2020/074520
§ 371 (c)(1),
(2) Date: Feb. 28, 2022

(87) PCT Pub. No.: WO2021/043857
PCT Pub. Date: Mar. 11, 2021

(65) Prior Publication Data

US 2022/0324671 A1 Oct. 13, 2022

(30) Foreign Application Priority Data

Sep. 4, 2019 (EP) ..... 19195296

(51) Int. Cl.
*B65H 29/60* (2006.01)
*B65H 29/24* (2006.01)
*B65H 45/04* (2006.01)

(52) U.S. Cl.
CPC ..... *B65H 29/60* (2013.01); *B65H 45/04* (2013.01); *B65H 2301/17* (2013.01);
(Continued)

(58) Field of Classification Search
CPC ..... B65H 29/58; B65H 29/60; B65H 29/62; B65H 29/245; B65H 2406/12;
(Continued)

(56) References Cited

U.S. PATENT DOCUMENTS 4,405,126 A * 9/1983 Frye ..... B65H 29/58 271/279
4,650,173 A 3/1987 Johnson et al.
(Continued)

FOREIGN PATENT DOCUMENTS

WO 2016209751 A1 12/2016

OTHER PUBLICATIONS

International Search Report with Written Opinion from PCT Application No. PCT/EP2020/074520, Dec. 11, 2020.
(Continued)

*Primary Examiner* — Luis A Gonzalez
(74) *Attorney, Agent, or Firm* — Eversheds Sutherland (US) LLP

(57) ABSTRACT

An apparatus for diverting and/or folding articles includes an infeed conveyor, an outfeed conveyor, and a diverter. The diverter is a non-contact, fluid emitting diverter, configured to emit a fluid jet to exhibit the diverting force on the impact zone of the article at a side of the article facing away from the outfeed entry. An angle of the average direction of the diverting force of the fluid jet with the outfeed path at the outfeed entry is in the range of 5° to 85°.

20 Claims, 17 Drawing Sheets

(52) U.S. Cl.
CPC ..... *B65H 2301/4461* (2013.01); *B65H 2406/1222* (2013.01); *B65H 2511/13* (2013.01); *B65H 2511/214* (2013.01); *B65H 2513/10* (2013.01); *B65H 2515/34* (2013.01)

(58) Field of Classification Search
CPC ..... B65H 2406/122; B65H 2301/4461; B65H 2301/448; B65H 2404/261
See application file for complete search history.

(56) References Cited

U.S. PATENT DOCUMENTS

| | | | |
|---|---|---|---|
| 4,835,947 | A | 6/1989 | Langen et al. |
| 2011/0305491 | A1 | 12/2011 | Hasegawa et al. |
| 2014/0117608 | A1 | 5/2014 | Braschoss et al. |
| 2014/0117615 | A1 | 5/2014 | Mori et al. |
| 2014/0339046 | A1 | 11/2014 | Wiedmann et al. |
| 2016/0250080 | A1 | 9/2016 | Wada et al. |

OTHER PUBLICATIONS

Extended Search Report from corresponding EP Application No. 19195296.9, Mar. 3, 2020.

* cited by examiner

METHOD AND APPARATUS FOR DIVERTING AND/OR FOLDING ARTICLES

BACKGROUND

There is disclosed a method and apparatus for diverting and/or articles, more particularly planar articles comprising an irregular, flexible and/or elastic shape such as cut web articles or absorbent articles, such as diapers, hygienic pads, cleaning cloths, floor cloths, etc.

An apparatus and method for manufacturing such articles is for example known from WO2016/209751 and U.S. Pat. No. 4,650,173. As described such articles are for example manufactured by means of an assembly line that comprises an apparatus operated according to a method for folding the articles, for example prior to packaging. There is described an embodiment of such a method that folds an unfolded diaper into a U-shape by moving one or more folding or tucker blades through an infeed path of the unfolded diapers. The tucker blades impact the unfolded diaper on a planar, outer side at the folding line and force the diaper at the folding line into an entry of an outfeed conveyor determining an outfeed path perpendicularly to said infeed path. It is clear, that in this way, the diapers are also diverted from the infeed path to the outfeed path by the tucker blades. There are disclosed embodiments which aim at increasing flexibility of the method and apparatus for folding articles with an increased flexibility, more particularly, a method and apparatus that is able to handle a larger variety of types of diapers, sizes of diapers, type of articles, etc. which might have differences in desirable folding requirements to better fit within a package, without the need for complex and time consuming operations such as removal and/or replacement of equipment in the assembly line. Additionally there is aimed at increasing flexibility by providing for a method to selectively apply the folding and/or diversion of the articles, as desired during the manufacturing process, for example to divert the articles to different stackers, or to fold or not fold the articles depending on the type of article being produced. In order to implement such a method there is made use of tucker blades that can be selectively controlled to avoid impact to divert an article, by for example selectively moving the tucker blade movement path out of the infeed path of the articles, or by slowing or halting the intermittent movement of the tucker blades such that impact on the articles is selectively avoided.

It is however desired to operate an apparatus and method at increasing operating speeds in order to efficiently produce such articles. When the operating speeds increase, it becomes increasingly difficult to operate the tucker blades in a flexible way, as moving, slowing and/or halting the tucker blades at high operating speeds requires increasingly higher amounts of force and energy. Further when operating speeds increase, the impact of the tucker blade on the article generates forces which risk damaging the article. Also removing the tucker blade again from in between the article, at such high speeds, causes high levels of friction which lead to the risk of displacing, deforming and/or damaging the article. It also becomes increasingly difficult at high operating speeds to ensure that the articles are fed to the tucker blades in such way that the tucker blade will impact the article at the location of the desired folding line.

There thus still exists a need for a method and apparatus for diverting and/or folding articles in a more flexible and reliable way and with a reduced risk of damaging the articles, and which overcomes the above-mentioned drawbacks. The need is particularly apparent for articles that are difficult to divert and/or fold reliably during high speed operations, such as for example articles with a general planar shape, and/or articles comprising an irregular, flexible and/or elastic shape, such as for example cut web articles or absorbent articles, such as diapers, hygienic pads, cleaning cloths, floor cloths, etc.

SUMMARY

According to a first aspect of the invention, there is proved an apparatus for diverting and/or folding articles comprising an infeed conveyor, an outfeed conveyor and a diverter, wherein:

- the infeed conveyor is configured to convey articles along an infeed path towards an infeed exit, where the articles can exit the infeed path, to an outfeed entry of an outfeed conveyor;
- the outfeed conveyor is configured to convey the articles along an outfeed path from the outfeed entry, where articles can enter the outfeed path from the infeed exit of the infeed conveyor;
- the infeed conveyor and outfeed conveyor are configured such that:
- an angle between the infeed path and the outfeed path at the infeed exit and the outfeed entry is in the range of 30° up to and including 150°; and
- the outfeed entry is positioned adjacent the infeed path, such that articles can continue along the infeed path downstream of the infeed exit without entering the outfeed entry; and
- the diverter is configured to divert an article from the infeed path to the outfeed entry of the outfeed conveyor by exhibiting a diverting force on an impact zone of the article at the infeed exit of the infeed conveyor,
- characterized in that the diverter is a non-contact, fluid emitting diverter, configured to emit a fluid jet to exhibit the diverting force on an impact zone of the article at a side of the article facing away from the outfeed entry.

Such a non-contact fluid emitting diverter has been found to enable a more reliable and flexible folding of the articles mentioned above, while reducing the risk of damage to the article, as the impact of the fluid jet on a zone of the article is reliably ascertained even when the article is flexible or irregular and the fluid jet impacting on the article creates less friction with and a more gentle impact on the article when compared to for example a tucker blade. Adjusting the diverter to selectively divert and/or fold an article, or to adapt the specific location at which the diverting force should impact the article, can be realized by adjusting the timing of the emitted fluid jet, which no longer involves acceleration or deceleration of mechanical impactors, thereby allowing for a more flexible operation that is able to adapt to the desired control scheme and/or variations in the timing, shape, feed rate, etc. of the articles without the need for complex operations or adjustment or replacement of mechanical parts.

According to an embodiment the diverter is configured such that:

- an angle of the average direction of the diverting force of the fluid jet with the outfeed path at outfeed entry is in the range of 5°-85°, for example in the range of 15°-75°; preferably in the range of 30°-60°; for example in the range of 45°+/−5°;
- an angle of the average direction of the diverting force of the fluid jet with the infeed path at infeed exit is in the range of 5°-85°; for example in the range of 15°-75°; preferably in the range of 30°-60°; for example in the range of 45°+/−5°; and/or the angle of the average direction of the diverting force of the fluid jet with the outfeed path at outfeed entry and/or the angle of the average direction of the diverting force of the fluid jet with the infeed path at infeed exit, are in the range of 40% up to and including 60% of the angle between the infeed path at the infeed exit and the outfeed path at the outfeed entry.

In this way an optimal impact on the zone of the article is realized, especially when the zone of the article that is impacted by the fluid jet is already in a diverted state in which this zone is no longer aligned with the infeed path, thereby realizing an increased diverting force and a decreased consumption of the fluid for the fluid jet.

According to a further embodiment, there is provided an apparatus, wherein the apparatus is configured such that one or more of the following settings of the apparatus:

the angle of the average direction of the diverting force with the infeed path;

the angle of the average direction of the diverting force with the infeed path; and/or the angle between the infeed path and the outfeed path at the infeed exit and the outfeed entry, are adjustable and/or are determined in function of one or more of the following parameters:

type of the articles;

thickness of the articles;

operating speed;

a desired impact zone on which the fluid jet impacts the articles.

This allows for a flexible and optimal operation of the apparatus even when, for example the apparatus is used for consecutive series production of different types of articles, articles with a different thickness, at a different operating speed, etc. This also makes it possible to set an optimal impact zone on which the fluid jet impacts the articles, so that preferably this impact zone has a surface area that is large enough to avoid damage to the article while impacted by the fluid jet, while preferably also remains targeted enough to impact the article with the fluid jet in a desired location during high speed movement of the article so that the desired output state of the article can be reached consistently.

According to a further embodiment, there is provided an apparatus, wherein the apparatus is configured such that one or more of the following settings of the apparatus:

the distance travelled by the fluid jet from the diverter to the article;

the fluid pressure of the fluid jet;

the flow rate of the fluid jet; and/or the timing and/or duration of the fluid jet, are determined in function of one or more of the following parameters:

type of the articles;

thickness of the articles;

operating speed; and/or a desired impact zone on which the fluid jet impacts the articles.

In this way, with such easy and quick adjustments, the machine can be set-up optimally for different types, thicknesses, etc. of articles in a consistent way. By adjusting the distance, also the surface area of the desired impact zone on which the fluid jet impacts the articles can be adjusted and optimized. When the distance is increased, the surface area of the impact zone will also increase and vice versa, because of the effect of the expansion of the fluid jet when emitted by the diverter to impact the article.

According to a further embodiment, there is provided an apparatus, wherein the apparatus comprises a guide assembly comprising a guide surface arranged at the infeed exit of the infeed conveyor and/or the outfeed entry of the outfeed conveyor, wherein the guide surface is configured, when at least a part of the article is diverted by the fluid jet, to guide the side of the article facing away from the fluid jet during at least part of the transition from the infeed path to the outfeed path, thereby determining a predetermined maximum distance travelled by the fluid jet along the average direction of the diverting force of the fluid jet.

In this way, the diverting force of the fluid jet can be exhibited in a more consistent and controlled way on the article, even when the article is in a diverted state. As the maximum distance along the average direction of the diverting force is determined by the guide surface, the diverting force exhibited on the zone of the article impacted by the fluid jet and the size of this impact zone will be a stable property during diversion of the article, even when other parts of the article proceed along the outfeed path, at an increasing distance with respect to the nozzle of the diverter. It is clear that by limiting this distance to a predetermined maximum value, the minimum force generated by a particular fluid jet on a desired zone of impact can be guaranteed, while the energy consumption and the amount of fluid needed for diverting articles is reduced.

According to still a further embodiment, there is provided an apparatus, wherein the infeed conveyor and outfeed conveyor comprise a common pulley arranged at the infeed exit and the outfeed entry, the guide assembly comprising the common pulley determining the guide surface.

This allows for an efficient and simple implementation of the guide surface that allows for a smooth and coordinated transition between the infeed conveyor and outfeed conveyor, while reducing the risk for stress and friction exhibited on the article by the guide surface.

According to a further embodiment, there is provided an apparatus, wherein the diverter is configured such that the average direction of the diverting force of the fluid jet intersects with the common pulley.

In this way the maximum distance along the average direction of the diverting force of the fluid jet is determined in a simple and efficient way, thereby allowing an efficient and consistent impact of the fluid jet on the article during the entire diversion operation, even when other parts of the article are traveling further down the outfeed conveyor.

According to a further embodiment, there is provided an apparatus, wherein the diverter is configured such that the average direction of the diverting force of the fluid jet intersects with an angular section of pulley between the tangent with the direction of the infeed path at the infeed exit and the tangent with the direction of the outfeed path at the outfeed entry, the guide surface determined by at least a part of the angular section.

In this way the diverting force generated by the fluid jet has an increased level of efficiency, consistency and controllability as the influence of the different stages of the article as it progresses during the diversion operation, variations between different articles, different types, length, thickness, etc. of articles, etc. have a reduced impact on the diverting force generated by the fluid jet.

According to still a further embodiment, there is provided an apparatus, wherein the apparatus further comprises:

at least one sensor configured to determine at least one infeed parameter related to the shape/and or state of the article in the infeed conveyor; and/or at least one sensor configured to determine at least one outfeed parameter related to the shape and/or state of the article in the outfeed conveyor; and a controller suitably coupled to said at least one sensor configured to determine at least one infeed parameter and/or coupled to said at least one sensor configured to determine at least one outfeed parameter, and said controller configured to control said apparatus in function of:

at least one desired infeed parameter and/or at least one desired outfeed parameter; and/or a desired ratio of at least one desired outfeed parameter with respect to at least one desired infeed parameter.

In this way the apparatus can be adaptively controlled in a flexible and simple way to output the article in the desired state along the desired path while coping with variations the shape and state of the article as it is provided as input to the apparatus. It further allows the apparatus to track and analyze the effect to any changes to operating parameters in order to determine, select and/or discover the most optimal operating parameters in a flexible way, taking into account the variations and changes in the shape and/or state of the article.

According to still a further embodiment, there is provided an apparatus, wherein:

Said at least one sensor comprises one or more of the following:

An optical sensor;

An image sensor;

A camera;

A three-dimensional camera;

A distance sensor;

A thickness sensor;

A length sensor;

An edge detection sensor; and/or

Said at least one parameter comprises one or more of the following:

The thickness of the article in its respective state in the infeed and/or outfeed conveyor;

The length of the article in its respective state in the infeed and/or outfeed conveyor;

The position of and/or distance between the upstream and downstream end of the article in its respective state in the infeed and/or outfeed conveyor;

The position of the article along and/or with respect to the infeed path and/or the outfeed path in its respective state in the infeed and/or outfeed conveyor.

In this way the desired output state and path of the article can be monitored and, if necessary, the operational parameters of the apparatus can be adjusted and/or evaluated.

According to still a further embodiment, there is provided an apparatus, in which the controller is configured to control said apparatus in function of said at least one desired infeed parameters, outfeed parameters and/or desired ratio, in such a way that:

the distance between opposing conveyor belts of the infeed conveyor and/or outfeed conveyor is adapted in function of the thickness of the article in its respective state in the infeed conveyor and/or outfeed conveyor, where the infeed conveyor and/or outfeed conveyor comprises opposing conveyor belts along the infeed path and/or the outfeed path in between which the article is conveyed; and/or the timing, duration, flow rate, pressure, width and/or length of the fluid jet emitted by the diverter is adapted in function of:

The thickness of the article in its respective state in the infeed and/or outfeed conveyor;

The length of the article in its respective state in the infeed and/or outfeed conveyor;

The position of and/or distance between the upstream and downstream end of the article in its respective state in the infeed and/or outfeed conveyor; and/or The position of the article along and/or with respect to the infeed path and/or the outfeed path in its respective state in the infeed and/or outfeed conveyor.

In this way a flexible, reliable and self-adjusting and self-optimizing apparatus is realized without the need for complicated adjustments of mechanical parts or knowledge of specialized operators.

According to still a further embodiment there is provided an apparatus, wherein the apparatus is configured to controllably perform one or more of the following operations on the article by controlling the timing and/or duration of the fluid jet emitted by the diverter in function of the position of the article along and/or with respect to the infeed path and/or the outfeed path:

unfolded diversion: when a zone of the article comprising the upstream end of the article in its state in the infeed conveyor is impacted by the fluid jet;

folded diversion: when a zone of the article downstream of the upstream end of the article in its state in the infeed conveyor is impacted by the fluid jet and the upstream end of the article is not impacted by the fluid jet;

reversing diversion: when only a zone comprising the downstream end of the article in its state in the infeed conveyor is impacted by the fluid jet, such that the downstream end is inserted into the outfeed entry of the outfeed conveyor as the upstream end of the article in its state in the outfeed conveyor;

no diversion: when the article is not impacted by the fluid jet such that the article continues along the infeed path from the infeed exit past the outfeed entry without entering the outfeed entry.

In this way, the apparatus is configured to flexibly and/or selectively perform a plurality of these operations without requiring large or complicated hardware adjustments by simply controlling the timing and duration of the fluid jet emitted by the diverter.

According to still a further embodiment there is provided an apparatus, wherein the apparatus further comprises a brake assembly comprising a braking surface arranged:

along the infeed path downstream of the infeed exit of the infeed conveyor; and along the infeed path downstream of the outfeed entry of the outfeed conveyor, and wherein the braking surface is configured:

when the article is not diverted by the diverter, to allow the article to continue along the infeed path downstream of the infeed exit; and when at least a part of the article is diverted by the fluid jet, to contact at least a part of the article along the infeed path downstream of the outfeed entry, such that this part of the article is decelerated in a direction away from the infeed exit and/or accelerated in a direction towards the outfeed entry.

According to still a further embodiment there is provided an apparatus, wherein the brake assembly comprises a braking pulley determining at least part of the braking surface.

According to a further embodiment there is provided an apparatus, wherein, the fluid emitted by the non-contact fluid emitting diverter consists of or comprises one or more of the following:

a pressurized gas;
compressed air;
a pressurized inert gas;
pressurized carbon dioxide;
pressurized nitrogen;
A liquid;
Water;
A mixture comprising a disinfectant;
Charged particles.

Preferably compressed air is used for the fluid jet as it is readily available and safe to use in most assembly lines.

According to a second aspect of the invention, there is provided a method of operating an apparatus for diverting and/or folding articles according to the first aspect of the invention, wherein the method comprises the steps of:

the infeed conveyor conveying the articles along an infeed path towards an infeed exit, where the articles can exit the infeed path, to an outfeed entry of an outfeed conveyor;

the outfeed conveyor conveying the articles along an outfeed path from the outfeed entry, where articles can enter the outfeed path from the infeed exit of the infeed conveyor;

the diverter diverting an article from the infeed path to the outfeed entry of the outfeed conveyor by emitting a fluid jet to exhibit a diverting force on an impact zone of the article at a side of the article facing away from the outfeed entry at the infeed exit of the infeed conveyor.

According to particular embodiments of the method, the apparatus is operated similarly as described below and/or similar as mentioned above with respect to particular embodiments of the apparatus.

According to further aspects of the invention there are provided a computer implemented method for performing the method of operating the apparatus according to the second aspect of the invention; a data processing apparatus comprising a processor configured to perform the method of operating the apparatus according to the second aspect of the invention; a computer program product comprising instructions which, when the program is executed by a computer, cause the computer to carry out the method of operating the apparatus according to the second aspect of the invention; a computer-readable storage medium comprising instructions which, when executed by a computer, cause the computer to carry out the method of operating the apparatus according to the second aspect of the invention; a computer-readable data carrier having stored thereon the latter computer program product; and/or a data carrier signal carrying the latter computer program product.

BRIEF DESCRIPTION OF THE DRAWINGS

Exemplary embodiments will now be described with reference to the drawings in which.

DETAILED DESCRIPTION OF VARIOUS EMBODIMENTS

Figure 1:
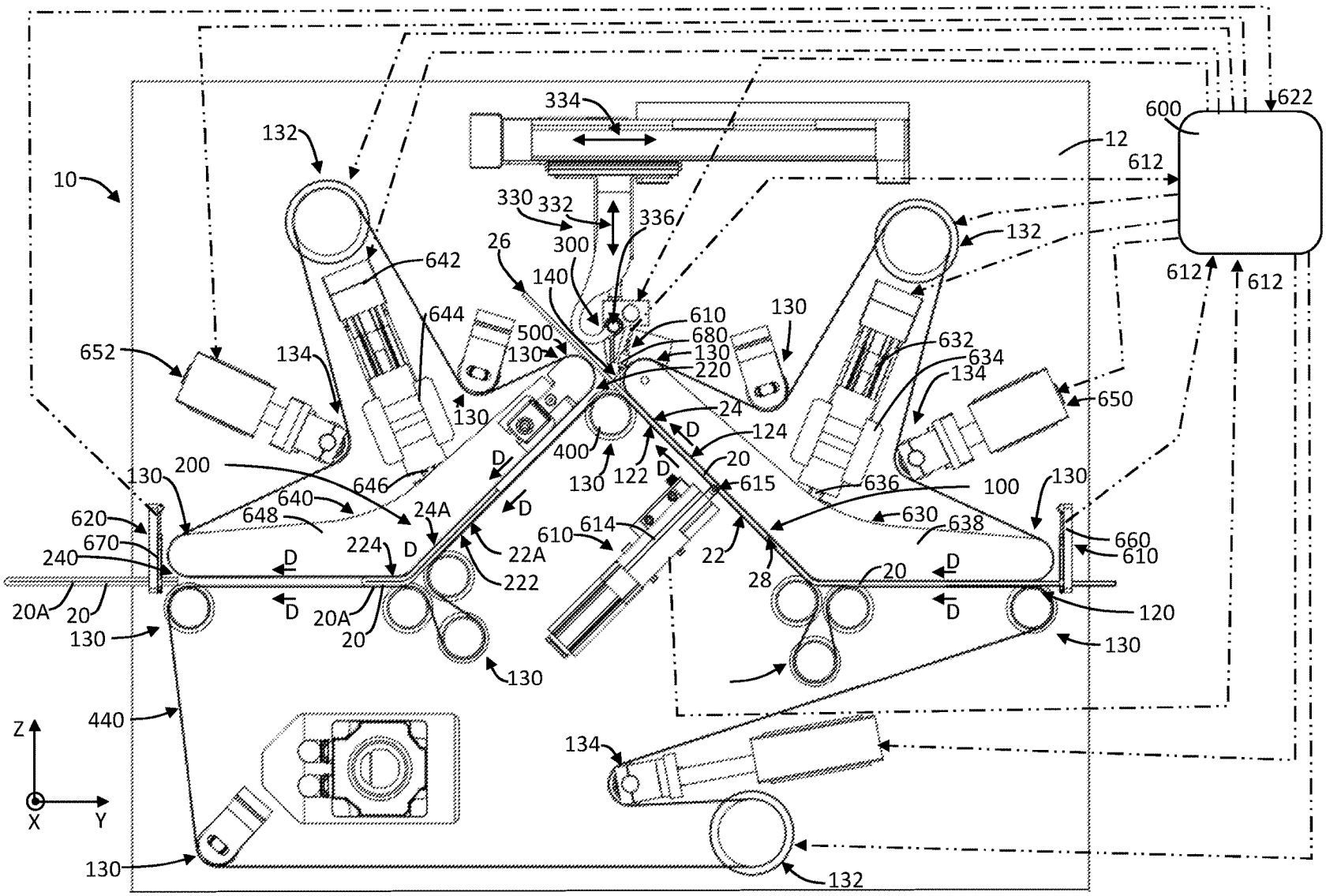
FIG. 1 schematically shows an embodiment of an apparatus for diverting and/or folding articles.
Figure 2:
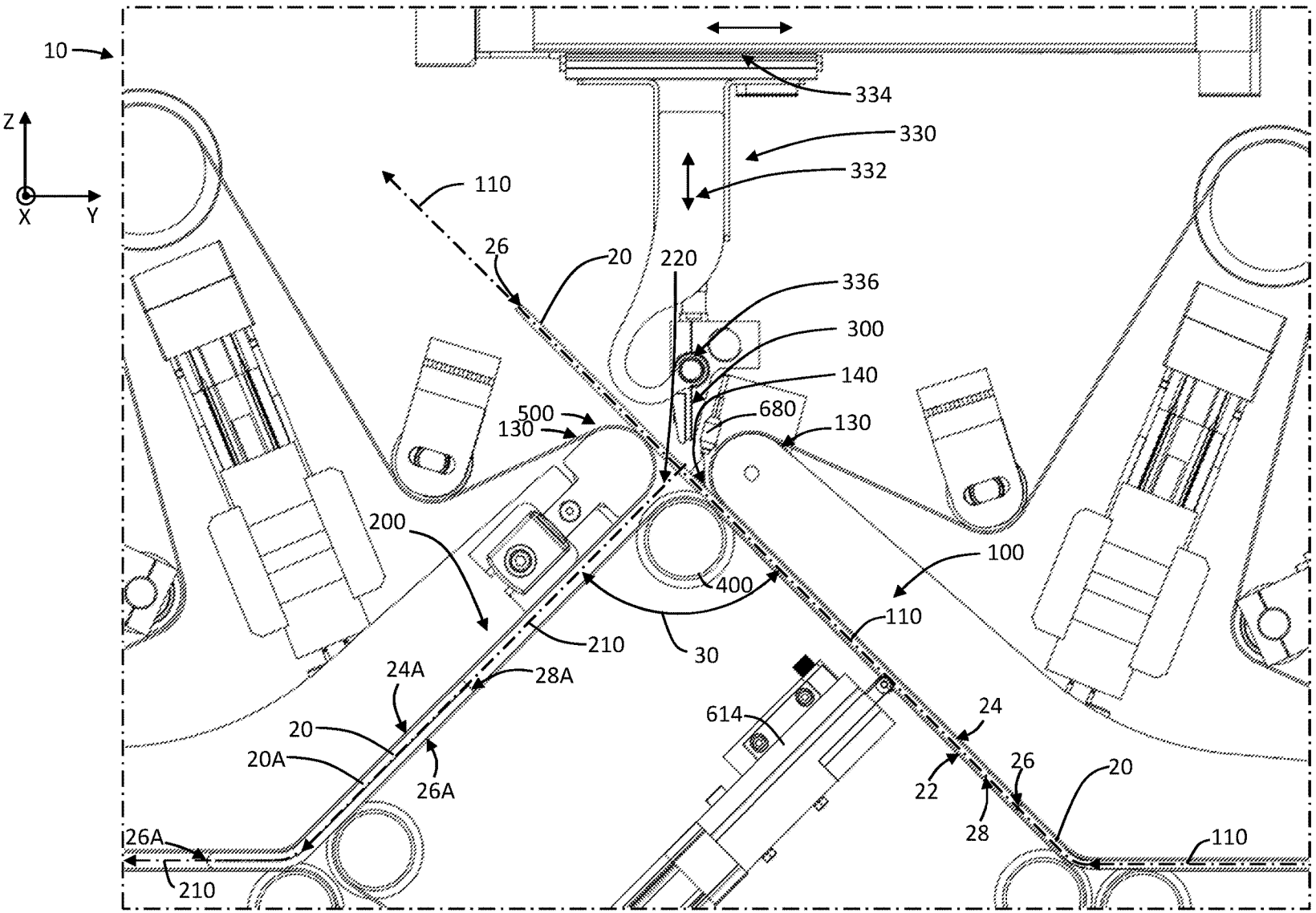
FIGS. 2-4 show fragments of the embodiment of FIG. 1 in further detail.
Figure 3:
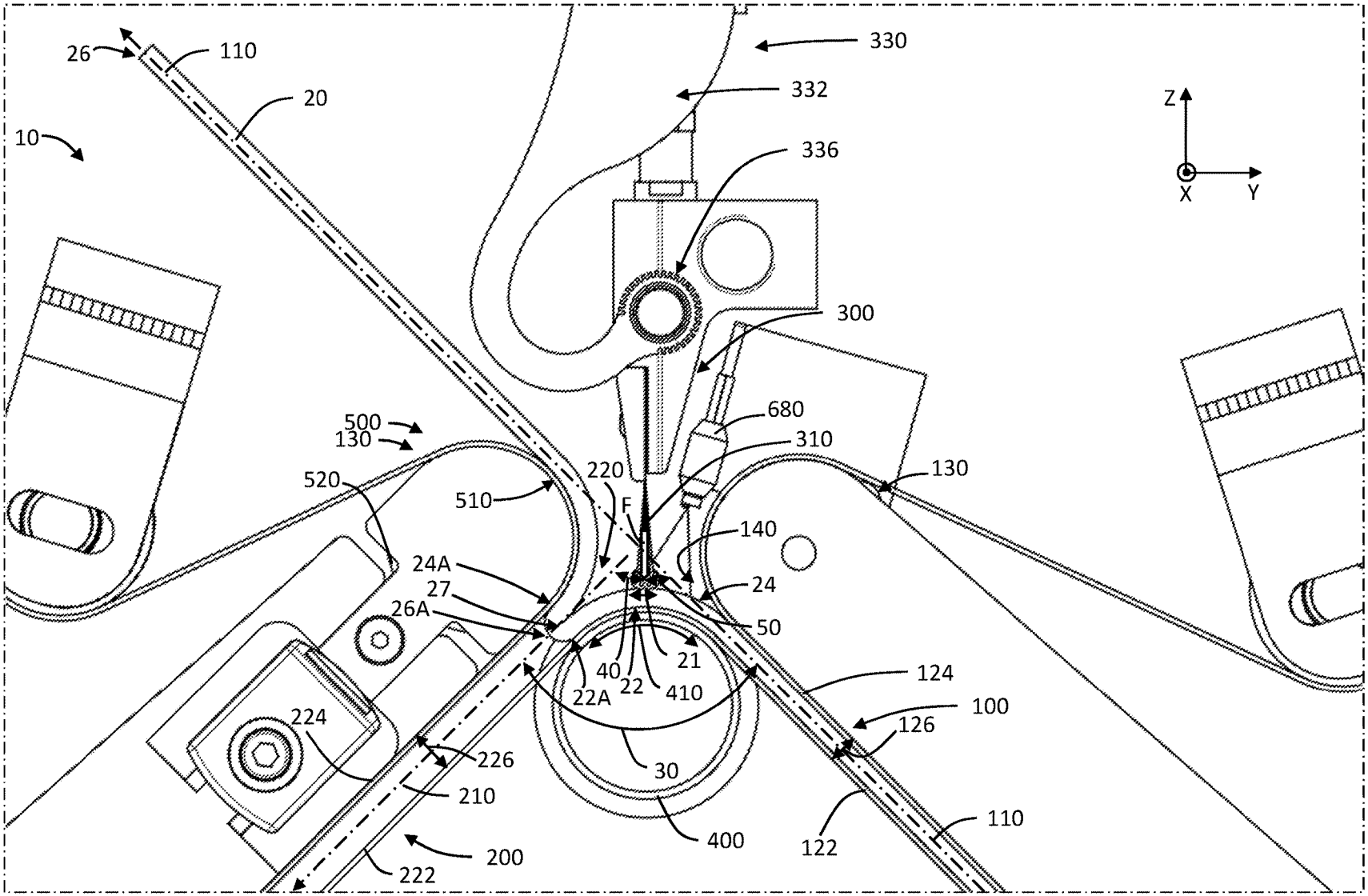
Figure 4:
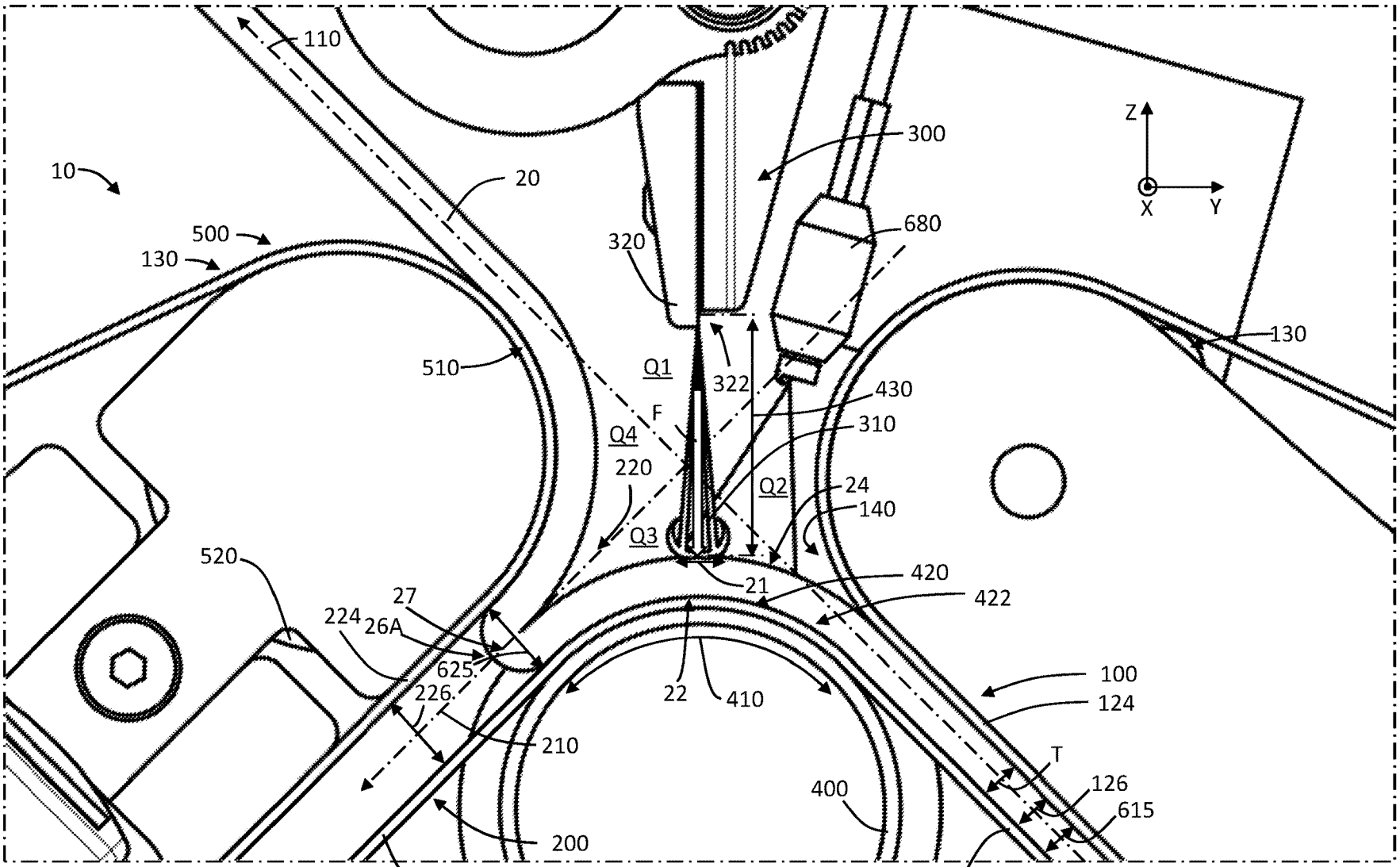
Figure 5:
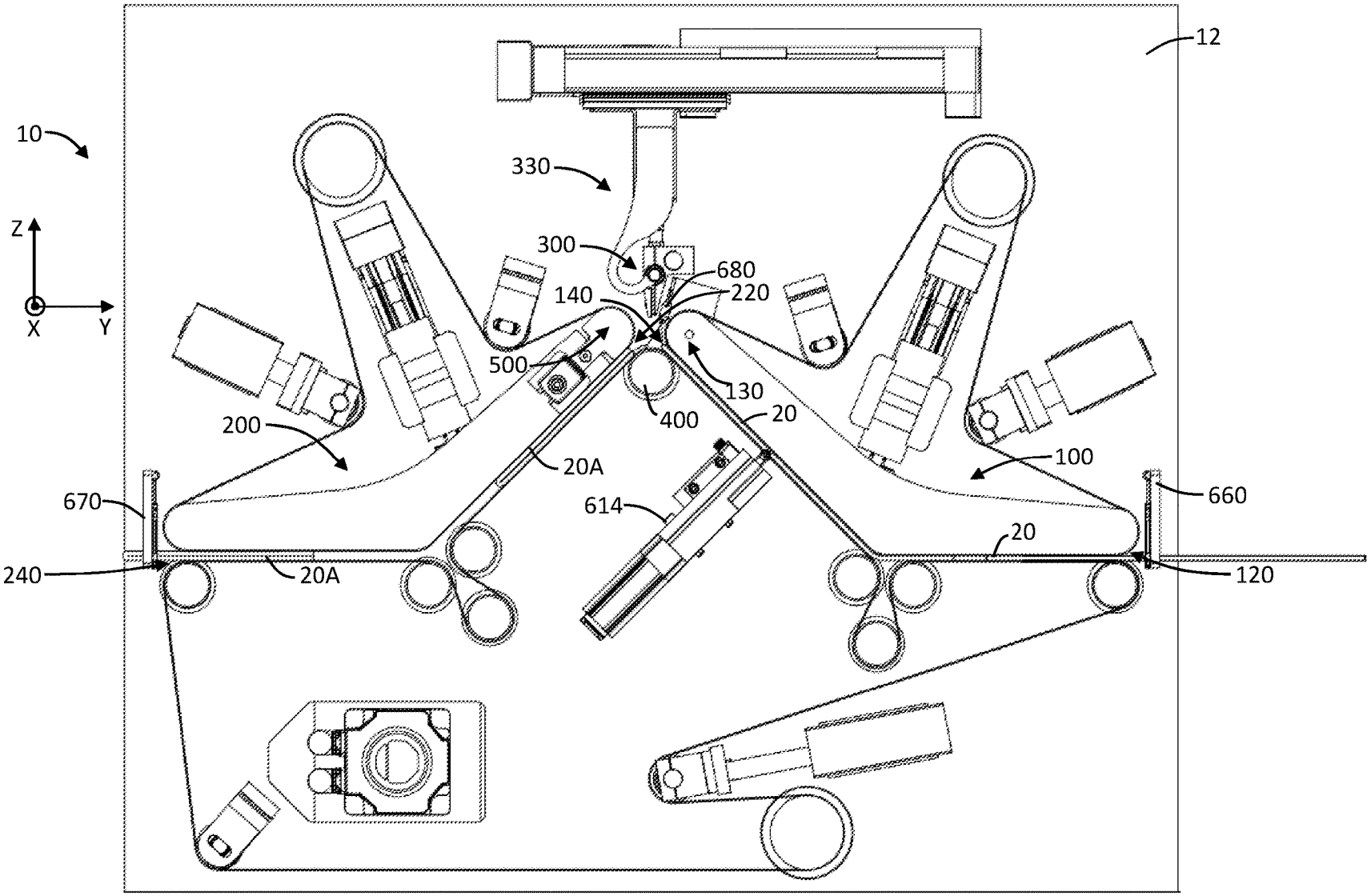
FIGS. 5-15 schematically show different phases of an embodiment of the method for diverting and/or folding articles.
Figure 6:
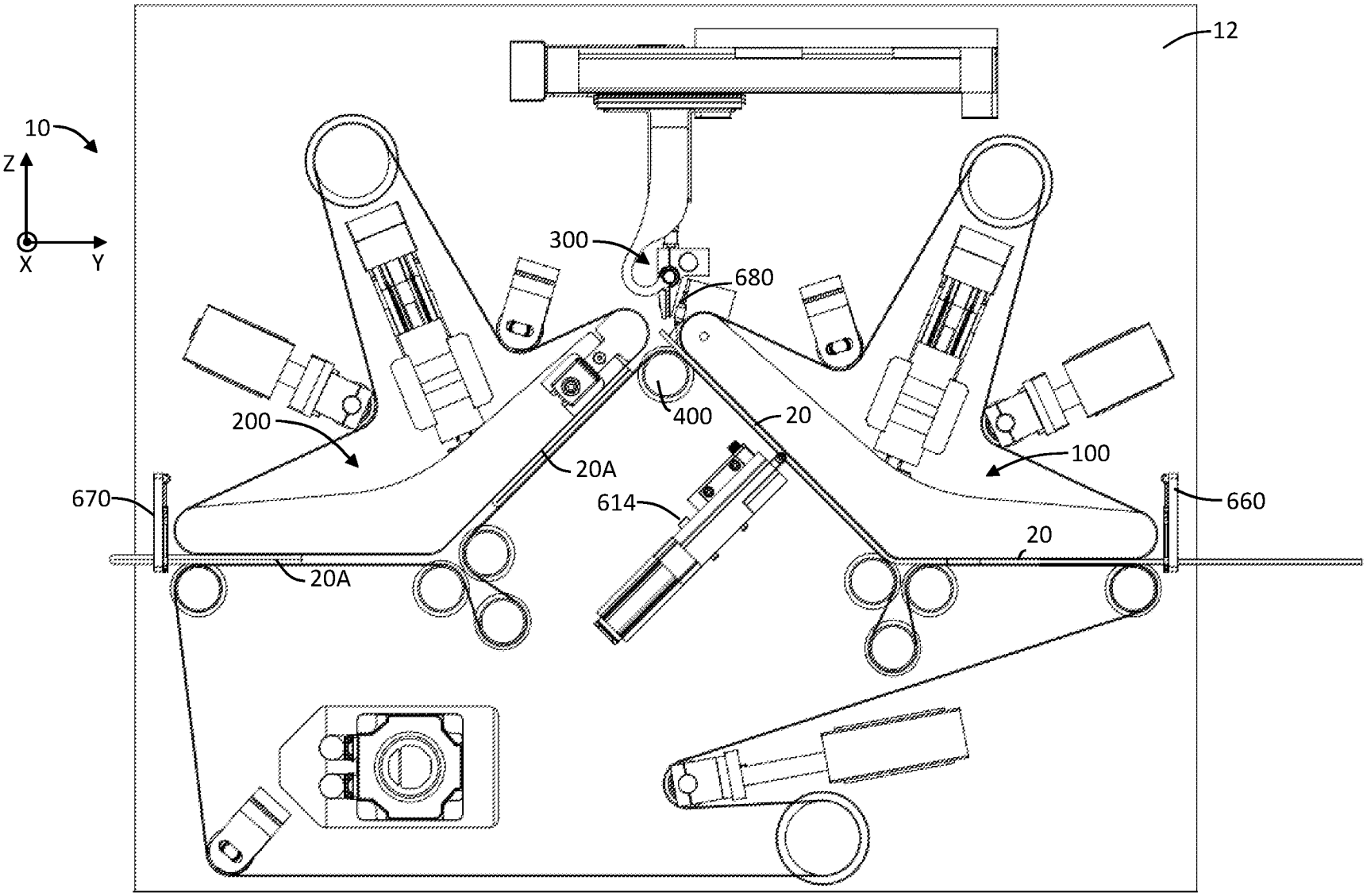
Figure 7:
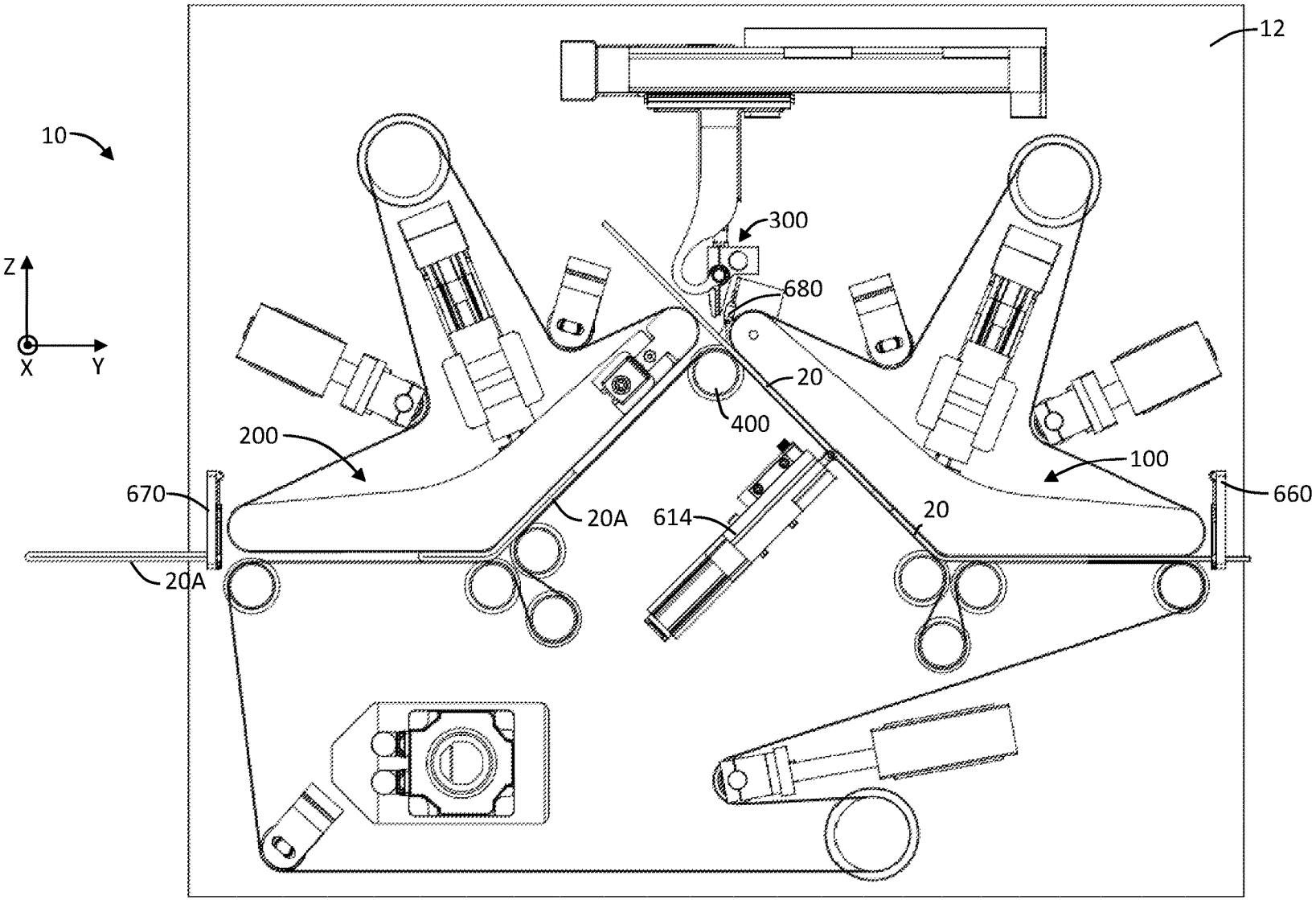
Figure 8:
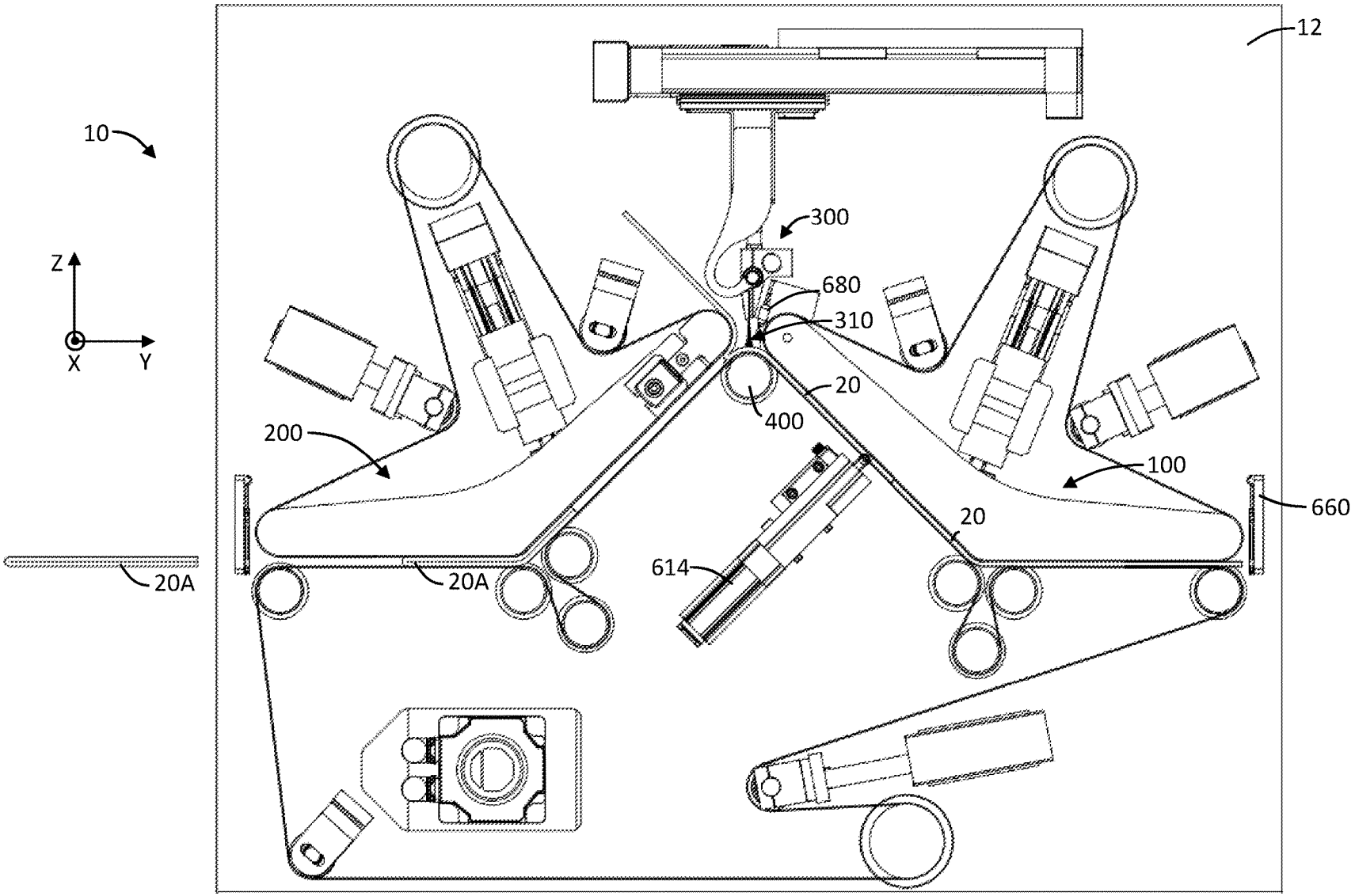
Figure 9:
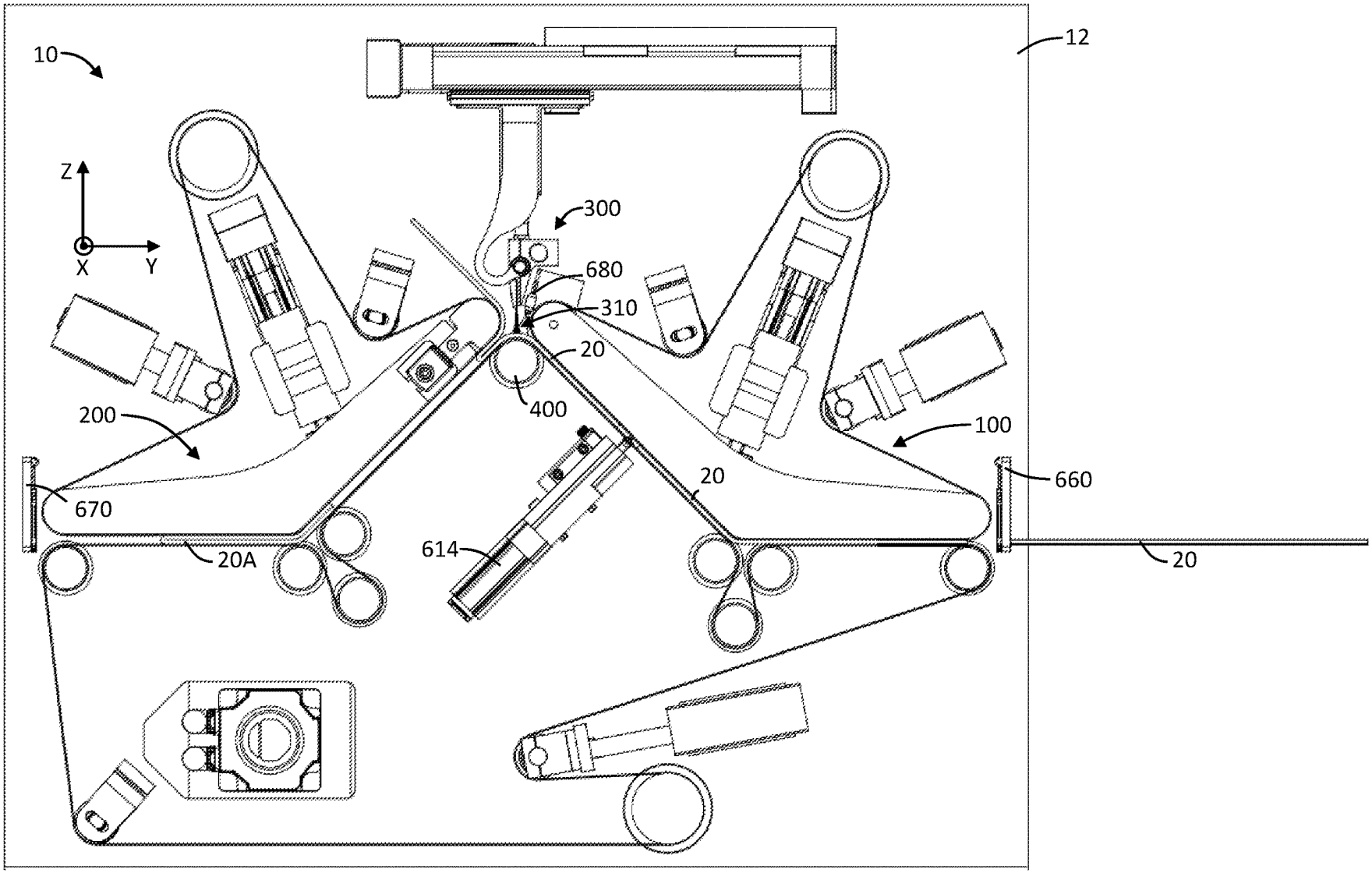
Figure 10:
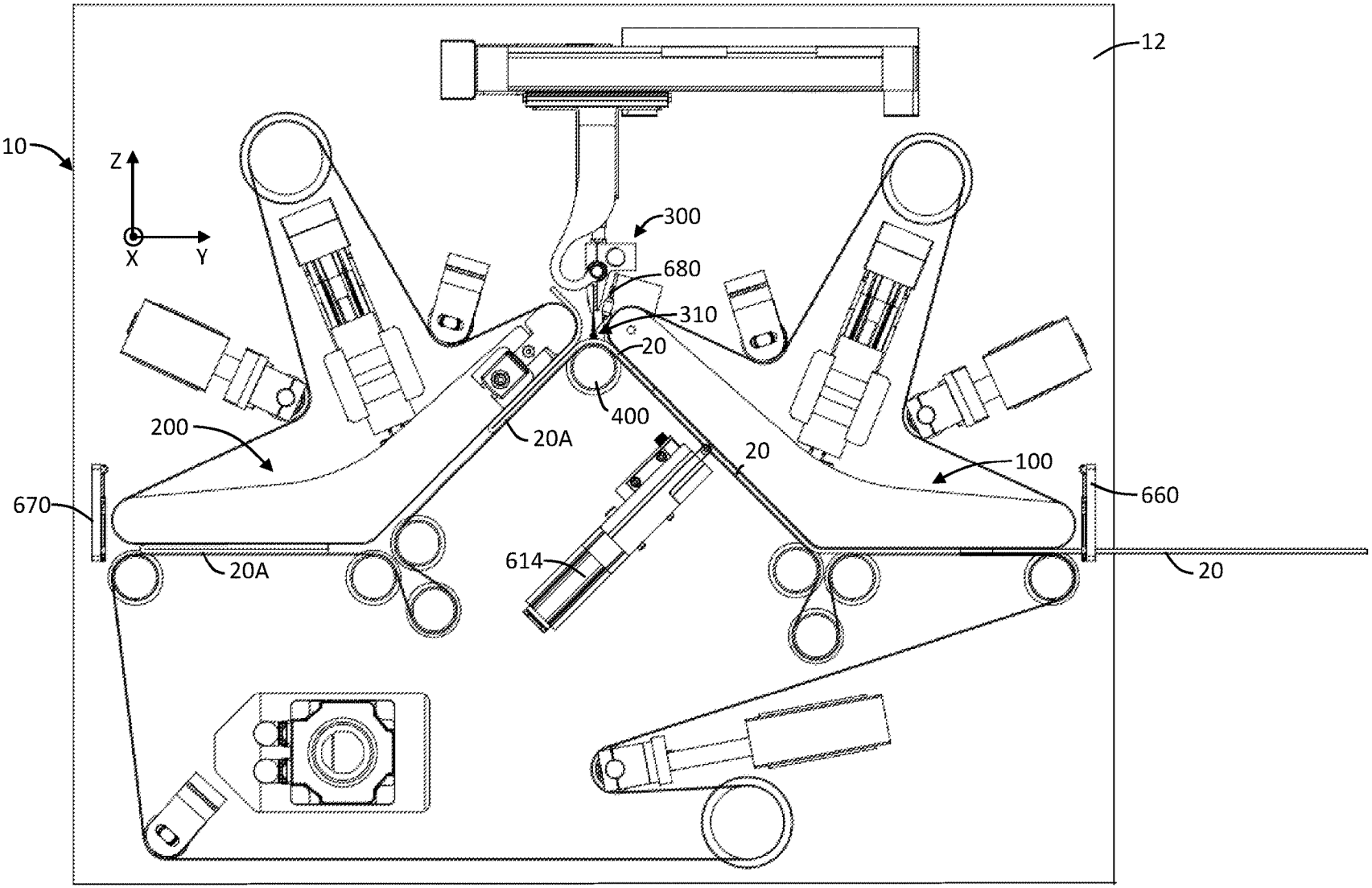
Figure 11:
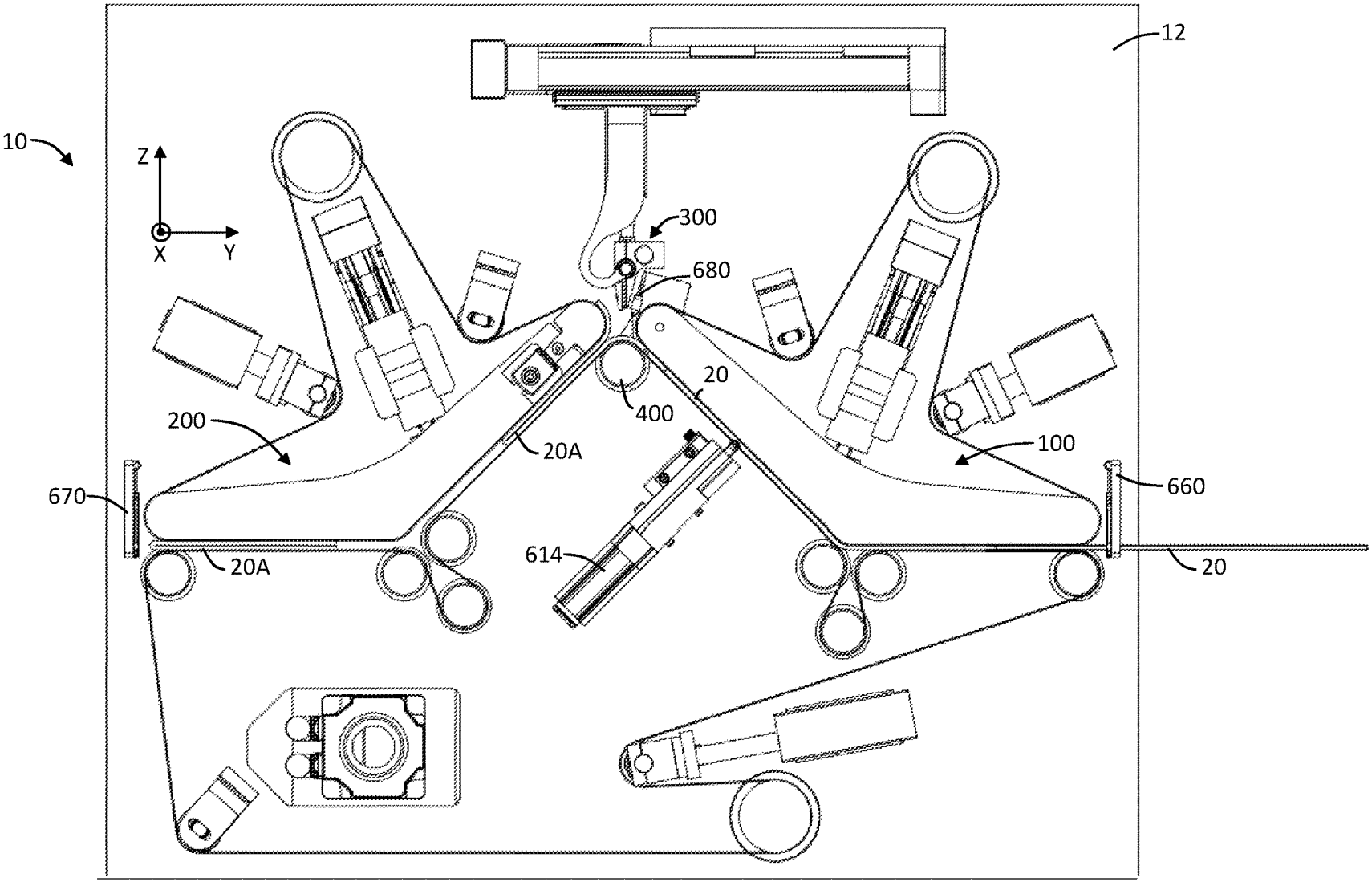
Figure 12:
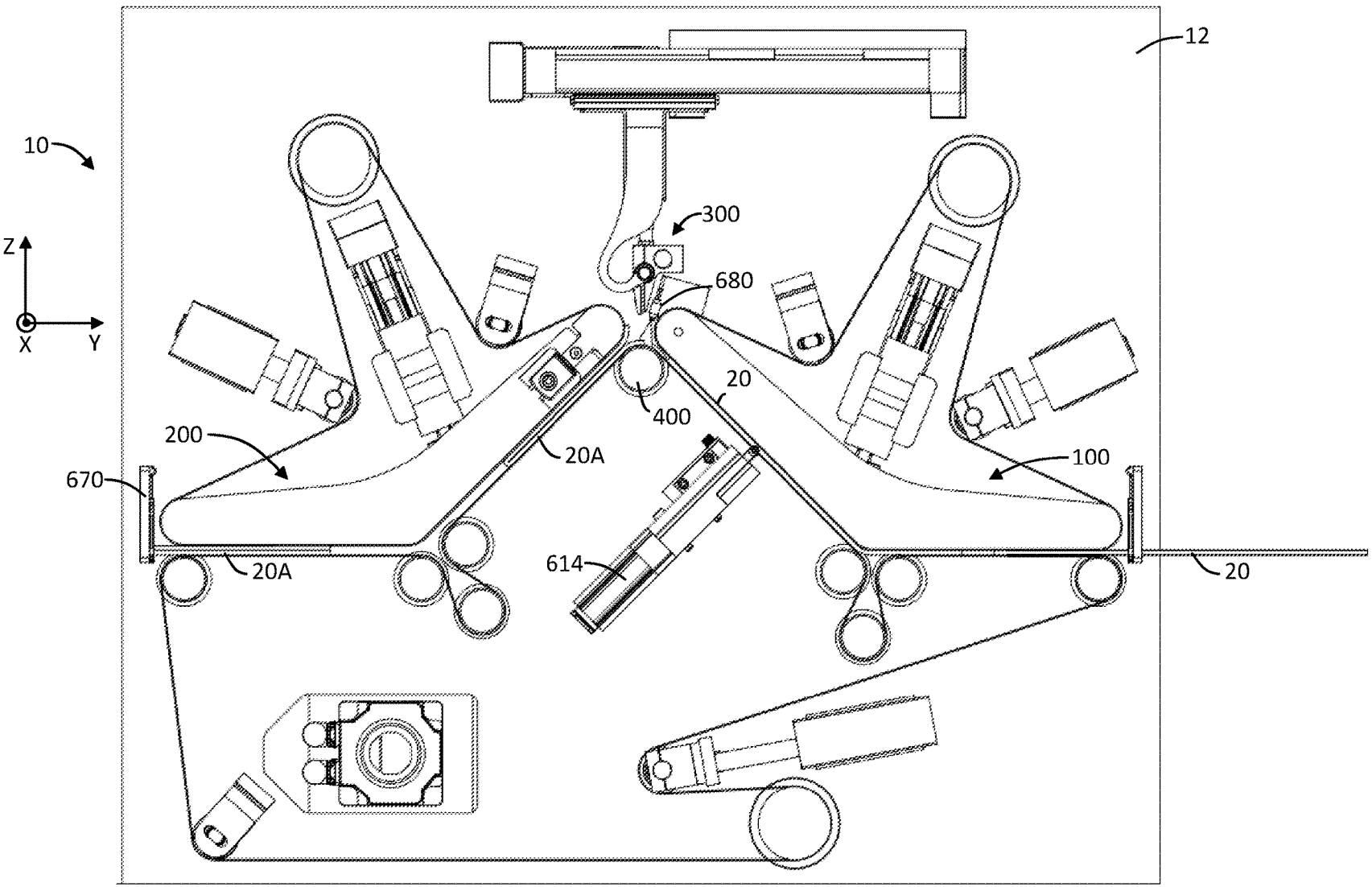
Figure 13:
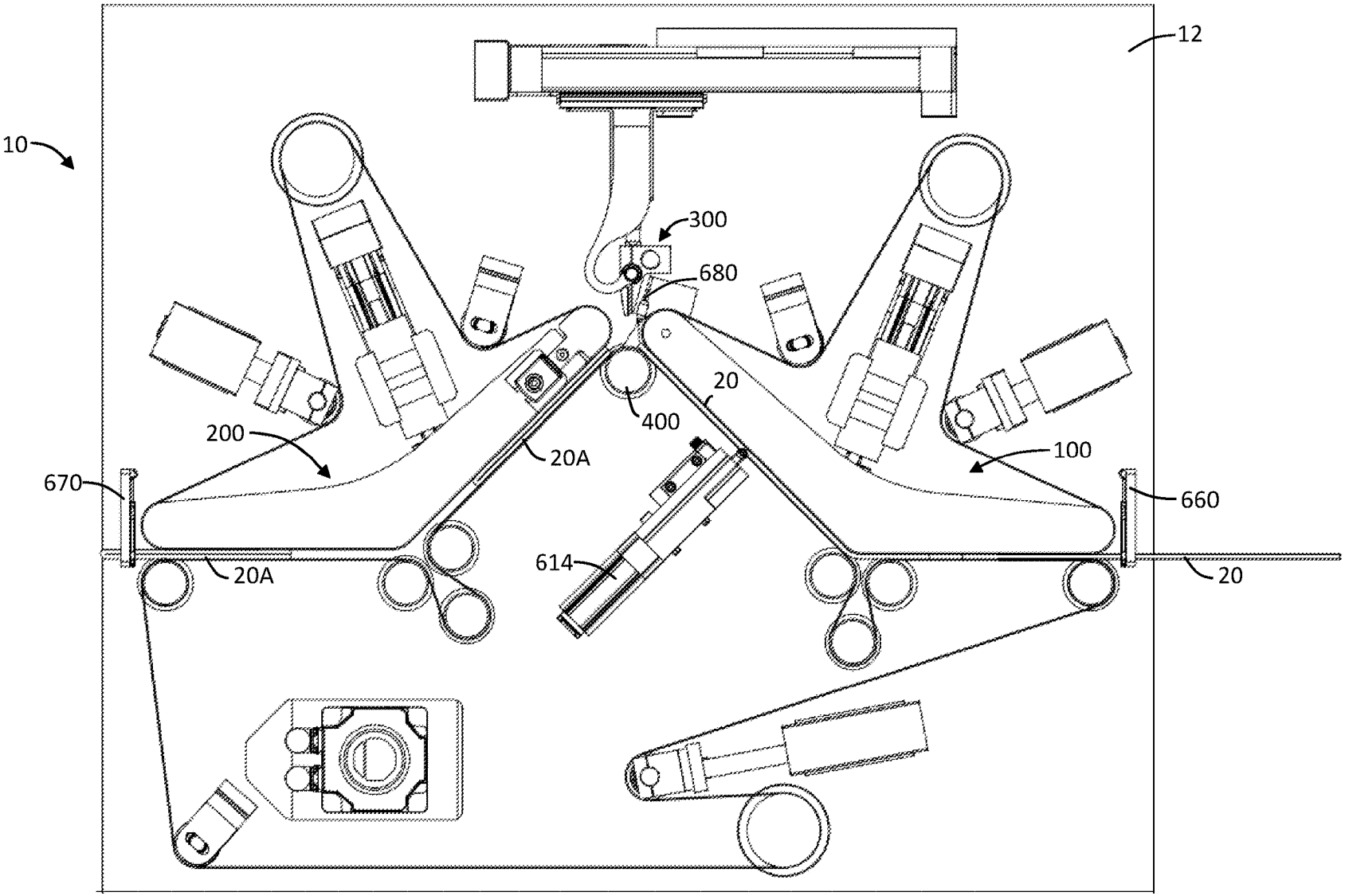
Figure 14:
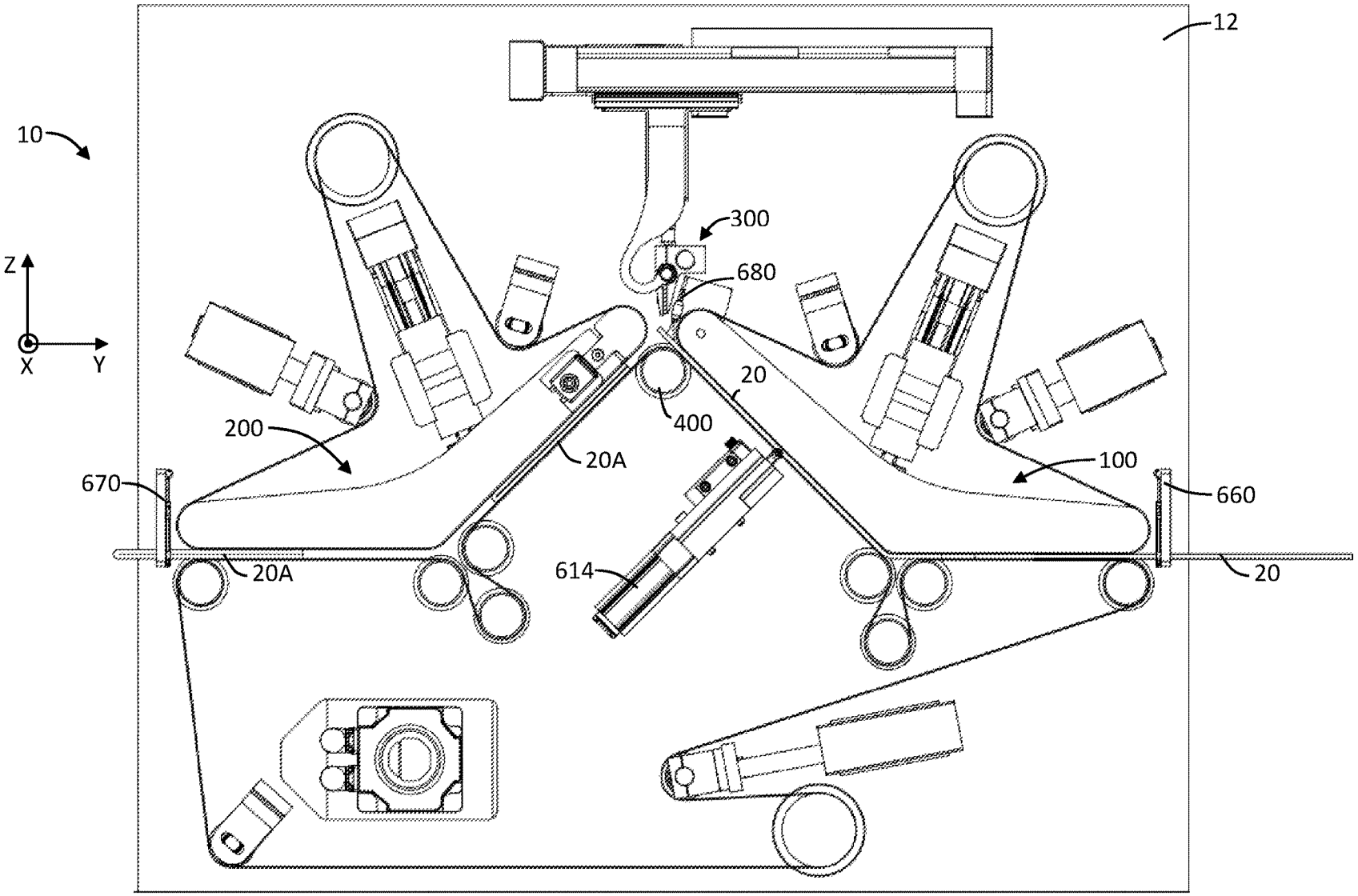
Figure 15:
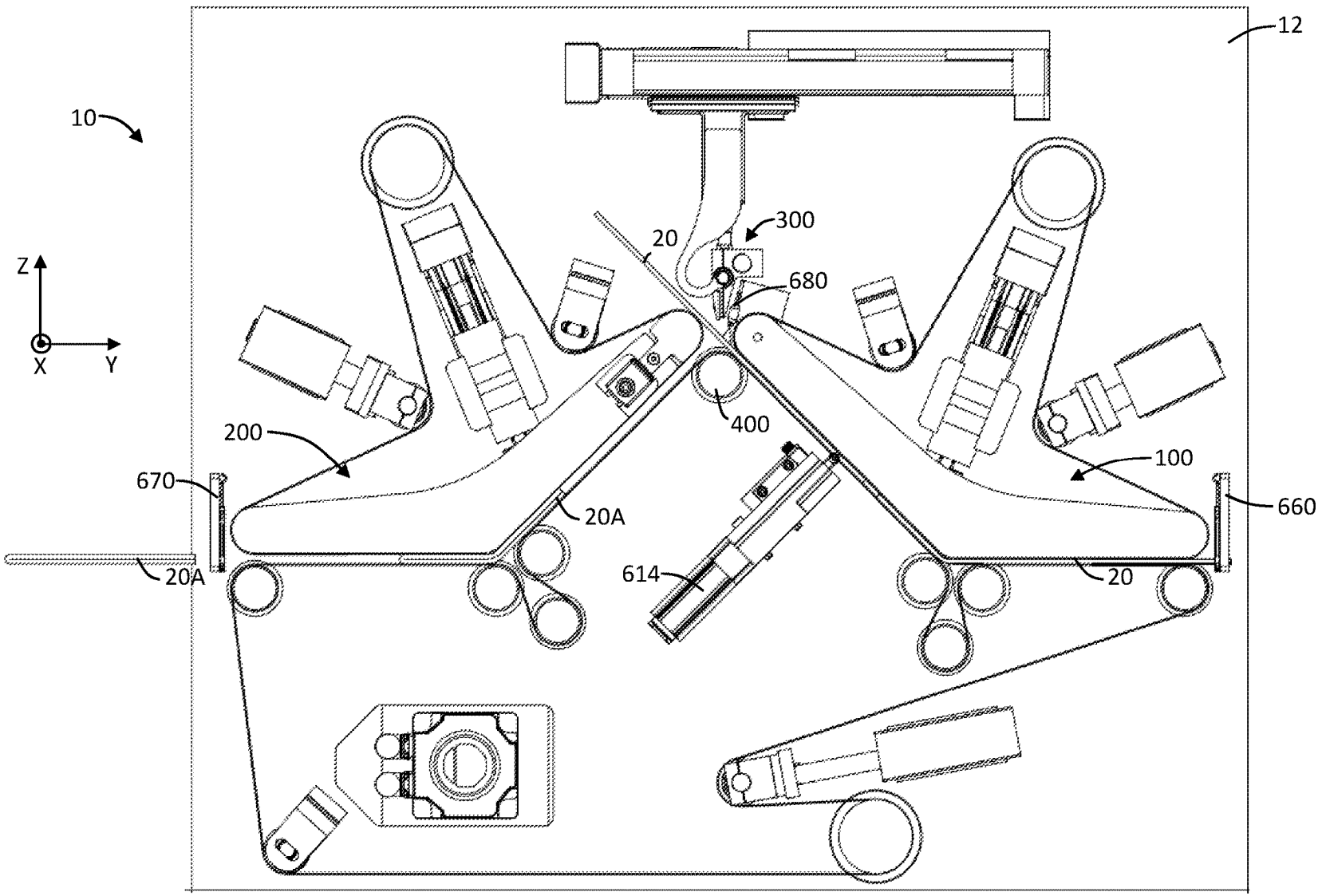

FIGS. 1-3 shows an exemplary embodiment of an apparatus 10 for diverting and/or folding articles 20. Such an apparatus 10 could for example form part of an assembly line, which comprises for example further upstream and/or downstream apparatus or subassemblies for the manufacturing, manipulation, . . . of the articles 20. As will be described in further detail below, these articles 20 are for example planar articles, which means they for example have two opposing outer sides 22, 24 which have a larger surface than the other sides of the article 20. According to an embodiment of the article shown in FIG. 1, the two opposing outer sides 22, 24 of the article 20, are for example bottom side 22 and a top side 24, which have a larger surface than the front side or upstream end 26, back side or downstream end 28, left side 32 and right side 34, the latter more clearly shown in for example FIGS. 16-19. It is clear that outer sides 22, 24 may comprise a planar surface, or substantially planar surface, in the sense that the sides comprise a substantially planar shape for a man skilled in the art of such articles as diapers, hygienic pads, cleaning cloths, floor cloths, napkins, etc. It is thus clear that such a planar shape of the planar sides 22, 24 also allows for an irregular, flexible, etc. planar shape, which could for example comprise suitable extensions, protrusions, stubble, patterns, flurry, fringes, etc. or any other suitable elements. It is thus clear that a skilled person in this technical domain would not interpret a planar article 20 with opposing planar sides 22, 24 as a straight article 20 comprising two opposing sides 22, 24 that are completely straight and/or flat. It is clear that alternatively or in combination with the embodiment of the planar article as described above, the article 20 could for example comprise an absorbent article, cut web article, etc. which are generally known to a man skilled in the art as flexible articles, according to some embodiments elastic, or at least comprising elastic parts, and/or parts comprising an irregular shape. However, it is clear that such articles typically comprise two outer sides which generally have a large surface area than the other sides of the article. Typically, the outer sides of such embodiments of the article with the larger surface are determined by the width and length of the article, while the other sides are associated with the depth or thickness of the article. Handling such types of articles at high speed is typically more challenging than articles such as paper, cardboard, plastic sheets, etc. which have a more predefined, regular shape with a predefined uniform thickness and level of rigidity and a smooth and/or flat outer surface. The operating speeds of an embodiment of the apparatus 10 such as described is for example such that the articles are conveyed at a speed of up to 16 m/s and for example the number of articles 20 handled by the apparatus 10 per minute is for example in the range of 300 to 2200. Similar as shown, in FIGS. 1-3 and Y-Z the thickness T of the article 20 is smaller than the width W and length L of the article 20, for example the thickness T is equal to or smaller than 10% of the width W and/or length L of the article 20. For an exemplary embodiment of the article 20, which is for example embodied as a floor mop or sweeper, such as for example a mopping or sweeping pad marketed under the generally known Swiffer brand or the Vileda brand, which for example has a length in the range of 5 cm-150 cm, for example 10 cm-100 cm and a width in the range of 2 cm-30 cm, for example 2 cm-15 cm and a thickness of 2 cm or less and larger than 1 mm or 2 mm. Other examples are for example articles such as diapers, etc. of which it is clear that typically the thickness is less than 3 cm, while the length and width are larger than 20 cm. It is clear that other alternative embodiments are possible in which for example the thickness of the article 20 is at least 3 times smaller, for example at least 5 times smaller than the thickness and/or the width of the article 20.

The embodiment of the apparatus 10 as shown in FIGS. 1-3 and the method it performs for automatically diverting and/or folding the articles 20, as will be explained in further detail below, results in suitably diverting the articles 20 to a desired outfeed path, and/or folding the articles 20, which for example means folding the articles 20 about a folding line transverse to the direction of movement of article 20 in the apparatus 10 substantially in the plane of planar article 20. As shown for example in FIG. 1, according to the embodiment shown, the apparatus 10 comprises an infeed conveyor 100. The direction of movement of the article 20 in the apparatus 10 is schematically indicated with arrows D. As further schematically shown, the infeed conveyor 100 is configured to convey articles 20 along an infeed path 110. As shown, the articles 20 are fed into the infeed conveyor 100 at an infeed entry 120. According to the embodiment shown, the article 20 is subsequently fed along the infeed path 110 in the movement direction D by the infeed conveyor 100. It is clear that, according to the embodiment shown, in the side view of FIG. 1, the length direction of the article 20 is aligned with the infeed path 110 and is thus also aligned with the direction of movement D. As shown, the embodiment of infeed conveyor 100 acts on the outer sides 22, 24 of the article 20 to convey the article 20 along the infeed path 110, or in other words the substantially planer, largest sides 22, 24 of the article 20. According to the embodiment shown, the infeed conveyor 100 comprises two opposing belts 122, 124 along the infeed path 110 in between which the article 20 is conveyed. As shown in FIGS. 1-3, this means that the first belt 122 contacts the outer surface 22 of the article 20 and that the opposing second belt 124 contacts the opposing outer surface 24 of the article 20.

This means that the opposing belts 122, 124 of the infeed conveyor 100 are spaced parallel to each other and to the infeed path 110 in such a way that the gap in between them corresponds to or is set in function of the thickness T of the article 20 when conveyed in between these opposing belts 122, 124. In other words, as shown in FIGS. 1-3, the belts 122, 124 of the infeed conveyor 100 extend longitudinally along the infeed path 110 and widthwise in the direction of the side view of these Figures. This means, with reference to the reference directions represented by the reference frame X, Y, Z which, with respect to the orientation of the embodiment shown in FIGS. 1-3 could be denoted as the height or vertical direction Z and two transverse horizontal directions X and Y, which could be referenced as the sideways or left/right direction X and the front/back direction Y, which is transverse to the directions X and Z. According to the embodiment shown the belts 122, 124 of the infeed conveyor 100 thus extend widthwise in a plane parallel to the X direction. As will be explained in further detail below, this thus means that the conveyor pulleys or rollers, such as idler pulleys 130, drive pulleys 132 and/or tensioning pulleys 134 of the infeed conveyor 100 for determining the path of the belts 122, 124, thus comprise a central rotation axis along the direction X, or in other words transverse to the infeed path 110, the direction of motion D, and the thickness T of the article 20 when traveling along the infeed path 110, or in other words substantially parallel to the width W of the article 20 when travelling along the infeed path 110. It is clear that in the context of this application, a conveyor pulley is to be interpreted as a mechanical device configured to change the direction of a conveyor belt of a conveyor. As known to a man skilled in the art such pulleys are configured to guide, drive and/or tension a conveyor belt of a conveyor, and are thus respectively referred to as idler pulleys, drive pulleys and/or tensioning pulleys. It is clear that, according to the embodiment shown, the pulleys are typically embodied as suitable rollers and could also be referred to as idler rollers, drive rollers and/or tensioning rollers, or alternatively idlers, drivers and tensioners.

As shown, the infeed conveyor 100 conveys the articles 20 fed in at the infeed entry 120 along the infeed path 110 towards an infeed exit 140. As shown, at the infeed exit 140 the articles 20 can exit the infeed path to an outfeed entry 220 of an outfeed conveyor 200. In the state of the embodiment apparatus 10 shown in FIGS. 1-3, it that the infeed conveyor 100 is also configured to allow the article 20 to continue to be conveyed along the infeed path 110, such that the article 20 can continue at least partly past the infeed exit 140. Or in other words the infeed path 110, as schematically shown, continues beyond the infeed exit 140 along the direction of the infeed path 110 at the infeed exit 140.

As shown in FIGS. 1-3, the embodiment of the outfeed conveyor is configured to convey articles 20 along an outfeed path 210. As shown, the articles 20 can enter the outfeed path 210 at the outfeed entry 220. As will be described in further detail below, the articles can enter the outfeed path 210 at the outfeed entry 220 from the infeed exit 140 of the infeed conveyor 100 by means of a diverter 300. As further shown, the outfeed conveyor 200 then conveys the articles 20 along the outfeed path 210 from the outfeed entry 220 towards an outfeed exit 240.

As schematically shown, similar as explained above the embodiment of the outfeed conveyor 200 comprises two opposing belts 222, 224 along the infeed path 110 in between which the article 20 is conveyed. As will be explained in further detail below, according to the embodiment shown, the article 20 travels in a folded state along the outfeed path 210 and is thus referenced as folded article 20A. As shown in FIGS. 1-3, this means similar as explained above with reference to the infeed conveyor 100, the first belt 222 contacts the outer surface 22A of the folded article 20A and the opposing second belt 224 contacts the opposing outer surface 24A of the folded article 20A. Although reference is made to the folded article 20A and its outer surfaces 22A, 24A in function of clarity, it is clear that the alternative embodiment are possible in which the article 20 travels in an unfolded, or partially folded state along the outfeed path 210 and in which thus the opposing belts 222, 224 contact the opposing outer surfaces 22, 24 of the article 20, which thus means the opposing outer surfaces of the article 20 in the state of the article 20 when being conveyed along the outfeed conveyor 200. As will be explained in further detail below, it is thus clear that the outer surfaces of the article 20 when conveyed along the infeed conveyor 100 do not necessarily correspond with the outer surfaces of the article 20 when conveyed along the outfeed conveyor 200, for example when the article 20 is conveyed along the outfeed conveyor in an at least partially folded state.

As shown in FIGS. 2 and 3, there is an angle 30 between the infeed path 110 and the outfeed path 210 at the infeed exit 140 of the infeed conveyor 100 at the outfeed entry 220 of the outfeed conveyor 200. The angle 30 of the embodiment shown is for example 90°, however it is clear that alternative embodiments are possible in which this angle 30 is in the range of 30° up to and including 150°, for example 45° up to and including 135°, preferably 60° up to and including 120°, for example 80° up to and including 100°.

As further shown in FIGS. 1-3 the outfeed entry 220 is positioned adjacent the infeed path 110. In this way the outfeed entry 220 is positioned such that the articles 20 can continue along the infeed path 110 downstream of the infeed exit 140 without entering the outfeed entry 220. It is thus clear that the angle 30 and the position of the outfeed entry 220 with respect to the infeed exit 140 thus allow the articles 20 to continue along the infeed path 110 downstream of the infeed exit 140 past the outfeed entry 220. As will be explained in further detail below, under control of the diverter 300, the article 20 can thus continue from the infeed exit 140, for at least a part of its length, past the outfeed entry 220 without entering the outfeed conveyor 200. It is thus clear that the infeed conveyor 100 and outfeed conveyor 200 are configured with the angle 30 and the position as described above to enable this. In other words the outfeed entry 220 of the outfeed conveyor is positioned next to the infeed exit 140 and the infeed path 110 downstream of this infeed exit 140, thereby forming a gap past which the article 20 can continue along the infeed path 110 or alternatively the article 20 can be introduced into this gap when it is diverted from the infeed path 110 for being conveyed along the outfeed path 210.

FIGS. 1-3 show an embodiment of a diverter 300. As shown, such a diverter 300 is positioned adjacent the infeed path 110 and the infeed exit 140 of the infeed conveyor 100. As further shown, the diverter 300 is positioned at the opposite side of the infeed path 110 with respect to the outfeed entry 220 of the outfeed conveyor 200, and in this way also adjacent the outfeed entry 220. As will be explained in further detail below, and shown for example in FIG. 3, the diverter 300 is configured to divert the article 20 from the infeed path 110 to the outfeed entry 220 of the outfeed conveyor 200 by exhibiting a diverting force F on a zone 21, which will be referred to as the impact zone 21, of the article 20 at the infeed exit 140 of the infeed conveyor 100. This means that the diverter 300 is suitably controlled to, upon activation exhibit, this diverting force F, and thus not necessarily means that all articles 20 conveyed along the infeed path 110 are diverted to the outfeed path 210 by the diverter 300. A suitable control system 600 could be provided, which suitable controls the diverter 300 to divert the article or not as desired by the specific method of operation of the apparatus 10. In other words, the diverter 300 is configured to for example selectively or controllably divert one or more selected articles 20, all articles 20, no articles 20, a non-empty set or sequence of articles, etc.

As shown in FIG. 3, the diverter 300 is embodied as a non-contact, fluid emitting diverter 300. The diverter 300 is configured to emit a fluid jet 310 to exhibit the diverting force F on an impact zone 21 of the article 20 at the side 24 of the article 20 facing away from the outfeed entry 220. It is clear that, as explained above, the diverter 300 could for example be suitably controlled to emit the fluid, upon activation, such that the diverting force F is exhibited on an impact zone 21 of the article 20 positioned at, or downstream of the infeed exit 140, in such a way that the impact zone 21 of the article being subjected to the diverting force F is diverted away from the infeed path 110 in a direction towards the entry 220 of the outfeed conveyor 200. As will be described in further detail below, it is clear that the fluid jet 310 emitted by the diverter 300, can be emitted, while at least a part of the article 20 not being submitted to the fluid jet 310, continues its path along the infeed path 110. It is thus clear that in this case the impact zone 21 of the article 20 that is submitted to the diverting force of the fluid jet 310 will correspondingly shift to further downstream positions of the article 20 during the time period that the fluid jet 310 is emitted. Or in other words, the article 20, at least partly, even at the location of the impact zone 21 where the fluid jet 310 impacts the article 20, is allowed to continue a movement component along a direction different from the direction of the diverting force F during activation of the fluid jet 310. It is clear that, for the embodiment shown in FIGS. 1-3, the diverter 300 emits the fluid in the impact zone 21 along the entire width of the article 20, or at least a substantial part of it, such as for example 50% or more of the width, preferably 70% or more, for example 80% or more of the width of the article 20.

As shown in FIG. 3, the direction of the diverting force F, this means for example the average, mean, central or axial direction of the flow of the fluid jet 310 is set to a predetermined angle 40 with respect to the outfeed path 210 and/or a predetermined angle 50 with respect to the infeed path 110. As shown in FIG. 3, it is clear that the sum of these angles 40 and 50 is equal to the angle 30 between the infeed path 110 and the outfeed path 210 as described above. It is clear that these angles 30, 40, 50 are determined at or adjacent the infeed exit 140 and/or the outfeed entry 220.

According to the embodiment shown the angle 40 between the average direction of the diverting force F of the fluid jet 310 and outfeed path 210 at the outfeed entry 220 is 45°. As explained above, according to the embodiment shown, the angle 30 between the infeed path 110 and the outfeed path 210 is 90°, and it is thus clear that in this way, according to this embodiment the angle 50 between the average direction of the diverting force F of the fluid jet 310 and the infeed path 110 at the infeed exit 140 is 45°, as the sum of the angles 40 and 50 totals the angle 30. It is clear that alternative embodiments are possible in which different angles 30, 40 and/or 50 are chosen. However, it is clear that preferably the angle 40 of the diverting force F, or in other words of the fluid jet 310 emitted by the diverter 300, with respect to the outfeed path 210 is in the range of 45°+/−5°, however, it is clear that alternative embodiments are possible in which the angle 40 is in the range of 5°-85°, for example 15°-75°, preferably 30°-60°, such as for example 40°, 45° or 50°.

It has been found that such a choice of this angle with respect to the outfeed path 210 at the outfeed entry 220 has the advantageous effect of diverting the article 20 towards the outfeed path 210 with a reduced risk for damaging the article 20, especially at high operating speeds. Further a more reliable and effective diversion of the impact zone 21 of the article 20 being impacted by the fluid jet 310 is realized, as more clearly shown in FIG. 3, once a part of the article 20 is diverted from the infeed path 110, the fluid jet 310 impacts this impact zone 21 of the article 20 in a substantially transverse way, there by maximizing the impact on this impact zone 21 of the article 20 in this state, which allows to maximize efficiency of the diverter as the diversion force F can be increased while the flow and thus the energy consumption related to the fluid jet 310 is reduced.

Similarly, it is clear that preferably the angle 50 of the diverting force F, or in other words of the fluid jet 310 emitted by the diverter 300, with respect to the infeed path 50 is in the range of 45°+/−5°, according to the embodiment shown in which the angle 30 between the infeed path 110 and the outfeed path 210 is for example 90°+/−5°. However, it is clear that also here alternative embodiments are possible in which the angle 50 is in the range of 5°-85°, for example 15°-75°, preferably 30°-60°, such as for example 40°, 45° or 50°. As explained above, this allows the efficiency of the fluid jet 310 to be maximized in the state for example shown in FIG. 3, in which the impact zone 21 of the article impacted by the fluid jet 310 is already in a diverted state with respect to the infeed path 110 at the infeed exit 140. It is however clear that still further embodiments are possible, in which preferably the angles 40 and 50 are in the range of 40% up to and including 60% of the angle 30, as this typically realizes an optimal impact on the impact zone 21 of the article 20 when in an already diverted state, in which this impact zone 21, extends transversely or substantially transversely, for example at an angle of 90°+/−10° with respect to the direction of the diverting force F of the fluid jet 310.

According to the embodiment shown, the fluid emitted by the non-contact fluid emitting diverter 300 is or comprises for example compressed air as will be described in further detail below. It is clear that alternative embodiments are possible in which the diverter makes use of other suitable fluids, such as for example other suitable gasses such as carbon dioxide, nitrogen, etc. and/or liquids such as water, a mixture comprising a disinfectant, etc., or any other fluid, such as for example a suitable jet of charged particles, etc. As will be described further below, the diverter 300, according to the embodiment shown, comprises a suitable nozzle 320 configured to eject the fluid which is fed to the diverter 300 at a suitable pressure and flow rate to generate the desired diverting force F when the fluid is emitted by the diverter 300 on an impact zone 21 of the article 20 as shown for example in FIG. 3.

As shown in FIGS. 1-3 the diverter 300 comprises a nozzle 320 configured to emit the fluid jet 310. According to the embodiment shown the fluid jet is a jet of compressed air 310 emitted from the nozzle 320. According to the embodiment of the nozzle 320 shown, the nozzle 320 comprises a plurality of nozzle outlets 322 as for example shown in more detail in FIG. 18. According to the embodiment shown, the nozzle outlets 322 are aligned along a direction transverse to the movement direction D and substantially parallel to the side 24 of the article 20 facing the nozzle 320. As shown in the side view of FIGS. 1-3, this means that the outlets 322 of the nozzle 320 of the diverter 300 are all at the same relative position and orientation with respect to the infeed path 110, the outfeed path 210, the infeed exit 140, and/or the outfeed entry 220. It is however clear that alternative embodiments of the diverter 300 are possible, for example comprising any suitable nozzle 320 comprising one or more suitable nozzle outlets 322.

As already mentioned above the angle 40 of the average direction of the diverting force F with the infeed path 110 at the infeed exit 140 can be set or adjusted to a suitable value. According to a preferred embodiment, the angle 40 is adjustable, and is can preferably be optimized in function of parameters of the article 20, such as for example the type, thickness, material, texture, width, length, etc. of the article 20, or other operational parameters such as for example the operating speed of the apparatus 10, or in other words the speed and/or frequency at which articles 20 are being processed by the apparatus 10, the desired impact zone 21 of the article 20 on which the diverting force F is exhibited, for example the location and/or size of the impact zone 21, etc. Similarly, the angle 50 of the average direction of the diverting force F with the outfeed path 110 at the entry 220 can be adjusted or optimized in function of such parameters. Still further, it is clear that, similarly, the angle 30 between the infeed path 110 and the outfeed path 210 at the infeed exit 140 and the outfeed entry 220 can be set or adjusted in function of such parameters.

According to the embodiment shown in FIGS. 1-3 in addition to the angles 40, 50 and/or 60 also other settings are preferably optimized such as for example the distance 430 of the nozzle outlet 322 of the nozzle 320 of the diverter 300 with respect to the article 20, this means the distance 430 between the nozzle outlet 322 and the side 24 of the article 20 facing the diverter 300 along the average direction of the diverting force F of the fluid jet. It is clear that this distance 430 changes during operation of the apparatus as will be described further below. For example, in the state shown in FIGS. 1 and 2, the distance 430 from the nozzle outlet 322 of the diverter 300 to the article 20, when the impact zone 21 of the article 20 is aligned with the infeed path 110, is larger than, the distance 430 from the nozzle outlet 322 to the impact zone 21 of the article 20 where the fluid jet impacts the article 20 when the part of the article 20 with the impact zone 21 is in a diverted state as for example shown in FIG. 3. According to the embodiment shown, the apparatus 10 further comprises a nozzle mounting assembly 30 which is configured to mount the nozzle 320 of the diverter 300 to a frame 12 of the apparatus 10 in such a way that the angles 40, 50, and/or 60 and/or the distance 430 is adjustable. According to the embodiment shown, the mounting assembly 330 comprises a plurality of adjustment mechanisms 332, 334, 336 which allow adjustment of the position of the nozzle with respect to two different directions such as indicated with arrows 332, 334, this means in the view of FIG. 2 upwards and downwards by position adjustment mechanism 332 and left and right by position adjustment mechanism 334, and an adjustment mechanism 336 which is configured to allow for a rotation of the nozzle of the diverter to adjust the angular position of the nozzle. It is however clear that alternative embodiments of such a nozzle mounting assembly 330 are possible.

It is clear that one or more alternative parameters could be used to define the relative position of the nozzle outlet 322 with respect to the impact zone 21 of the article 20 during operation of the apparatus 10. Such parameters could for example be the distance 430 along the average direction of the diverting force F, as for example shown in FIG. 3, between the nozzle outlet of the diverter and the infeed path 110, the outfeed path 210, a central longitudinal axis of the article 20, a belt or any other suitable guide surface, an idler, etc. or any suitable combination thereof.

As shown in FIG. 3, according to the embodiment shown, when ejected from the nozzle outlet 322, the jet of fluid, according to this embodiment for example compressed air, will expand as the distance from the nozzle outlet 322 increases. As shown, according to the side view, or in other words transverse to the movement direction D of the article 20, this results in a widening jet of fluid in a direction away from the nozzle outlet 322. According to the embodiment shown in FIG. 3, the opening of the one or more nozzle outlets, this means the opening of the nozzle outlet along the Y direction, is for example is for example 0.2 mm-5 mm wide, for example 2 mm. The fluid jet 310 is thus at the location of these one or more nozzle outlets for example 2 mm wide along this Y direction. Subsequently as shown the fluid jet, as the distance with respect to the nozzle outlet increases, expands along this Y direction, thereby becoming wider. In this way, when the fluid jet impacts the side of the article facing the diverter, this width of the fluid jet will have further increased to correspond the width of the impact zone 21 of the article 20 that is subjected to the emitted fluid jet. As shown the width of the impact zone 21 of the article 20 is for example 3 mm-30 mm wide, for example 10 mm, or for example 2 times-20 times as wide as the width at the nozzle outlet of the diverter. In this way the force F generated by the fluid jet can be exerted on an impact zone 21 of the article 20 that is sufficiently wide to absorb this force without the risk of damaging the article 20. Preferably the width of the fluid jet is also chosen to be sufficiently small so that the impact zone 21 can be chosen with sufficient precision in order to increase the force being generated while reducing the fluid consumption and to be able to position the impact zone 21 at the desired location of the product to realize the desired diversion with a sufficient level of precision.

According to the embodiment shown in FIGS. 1-4, the apparatus 10 comprises an infeed conveyor 100 and an outfeed conveyor 200, which comprise a common idler pulley 400 arranged at the infeed exit 140 and the outfeed entry 220. According to the embodiment shown this means that the first belt 122 of the infeed conveyor 100, this means the lower belt 122 in the orientation shown in FIG. 1, and the first belt 222 of the outfeed conveyor 200, this means the lower belt 222 in the orientation shown in FIG. 1, form a common endless conveyor belt 440 or conveyor track along a plurality of pulleys 130, 132, 134 configured to suitably guide, drive and tension the common conveyor belt 440 of the infeed conveyor 100 and outfeed conveyor 200. Or in other words, the lower conveyor belts 122, 222 of the infeed conveyor 100 and the outfeed conveyor 220 are part of this common conveyor belt 440.

As for example shown in FIGS. 3, according to this embodiment, the pulley 400 comprises an angular section 410 between the tangent with the direction of the infeed path 110 at the infeed exit 140 and the tangent with the direction of the outfeed path 210 at the outfeed entry 220. As further shown and as explained above, according to this embodiment, the diverter 300 is configured such that the average direction of the diverting force F of the fluid jet 310 intersects with this angular section 410 of pulley 400. It is clear that, for the embodiment shown, similarly, this means that the average direction of the diverting force F of the emitted fluid jet 310 intersects with the conveyor belt 440 contacting this angular section 410 of the pulley 400. In the state of the apparatus shown in FIG. 3, when the fluid jet 310 is emitted by the diverter 300, it is clear that, in other words, the average direction of the diverting force F of the fluid jet 310 is directed to the pulley 400, and more specifically this angular section 410 of the pulley 400, this means the angular section 410 of the circumference of this pulley 400. Or in other words, according to the embodiment shown, the average direction of the diverting force F of the fluid jet 310 is not tangential to the pulley 400, this means, not tangential to the circumference of the pulley 400.

It is thus clear that, according to the state of the embodiment shown in FIG. 3, the common pulley 400, and more specifically the angular section 410 determines a guide surface 420. As will be explained in further detail below, according to the embodiment shown, the guide surface 420 extends along and corresponds to this angular section 410. However, it is clear that alternative embodiments are possible, in which the guide surface 420 is determined by only a suitable part of this angular section 410. In other words, according to such embodiments the guide surface 420 is determined by at least a part of the angular section 410 of the common pulley 400. It is clear that still further alternative embodiments are possible, in which the guide surface 420 is determined by any suitable portion of the circumference of a common pulley 400 arranged at the infeed exit 140 and the outfeed entry 220.

According to the state of the embodiment shown in FIG. 3, such a guide surface 420 of the apparatus 10 guides the side 22 of the article 20 facing away from the fluid jet 310. It is thus clear that, as shown, in this way the guide surface 420 determines a predetermined maximum distance 430 travelled by the fluid jet 310. This means that the maximum distance 430 travelled by the fluid jet 310 along the average direction of the diverting force F is limited by the presence of the guide surface 420. As shown, as the average direction of the diverting force F of the fluid jet 310, as explained above, comprises a suitable angle with respect to the infeed path 110 and the outfeed path 210 by means of a suitable configuration of the diverter 300, it is clear that the guide surface 420 is suitably arranged at the infeed exit 140 of the infeed conveyor 100 and the outfeed entry 220 of the outfeed conveyor 200, such that the article 20, when diverted, such as for example in the state shown in FIG. 3, will be forced by the side facing away from the fluid jet 310 against the guide surface. Or in other words, the amount of diversion from the infeed path 110 of the part of the article 20 impacted by the fluid jet 310 will be limited by the guide surface 420. In general this thus means that, when at least part of the article 20 is diverted by the fluid jet 310, the maximum distance 430 between the article 20 and the infeed path 110 along the direction of the average diverting force F will be determined in this state, by the fluid jet 310 from the infeed path 110, will be determined and/or limited by the guide surface 420, which prevents a further increase of this diversion of the part of the article 20 impacted by the fluid jet 310. As shown in the state of the embodiment shown in FIG. 3, the guide surface 420 functions to guide the side 22 of the article 20 facing away from the fluid jet 310 during at least part of the transition from the infeed path 110 to the outfeed path 210 when at least a part of the article 20 is diverted by the fluid jet 310. According to the embodiment shown the guide surface 420 is formed by the stretch of the common lower conveyor belt 440 covering the at least a part of the angular section 410 of the common idler 400. However it is clear that alternative embodiments are possible in which for example the a suitable guide assembly 422 comprises a suitable guide surface, which is for example formed by a suitable part of the common pulley 400 or any other suitable roller itself, or in which such a guide assembly 422 comprises a guide surface 420 that is formed by means of any other suitable element that is suitable for guiding the relevant part of the article 20 when diverted during transition from the infeed path 110 to the outfeed path 210. It is clear that according to further embodiments, the guide surface 420, does not necessarily need to be part of the infeed conveyor 100 and/or the outfeed conveyor 200. The guide surface 420 could for example a suitable angular section of the circumference of a suitably arranged roller or a suitable guide plate, suitably arranged in a transition between the infeed conveyor and the outfeed conveyor, which for example could alternatively be embodied as two entirely separate conveyors comprising no common conveyor elements. It is clear that still further embodiments are possible in which the guide surface 420 is not formed by a single element such as a suitable part of a pulley, roller, conveyor belt, etc. but by a plurality of suitable elements such as a plurality of pulleys, rollers, guide plates, conveyor belts, etc. or any suitable combination of one or more of such elements, suitably arranged at the infeed exit 140 and/or the outfeed entry 220, and/or in the transition between the infeed exit 140 and the outfeed entry 220. Or in other words, the guide surface 420 does not necessarily need to be an entirely common guide surface 420 for both the infeed conveyor 100 and the outfeed conveyor 200.

It is clear that similar as explained above, in such alternative embodiments, preferably also the guide surface 420 of such alternative embodiments is configured such that the average direction of the diverting force F of the fluid jet 310 intersects with at least a part of the guide surface 420. In other words, when impacted by the fluid jet 310, the side of the article 20 opposite to the side of the impact zone 21 on which the fluid jet 310 impacts, and more specifically the main component of the fluid jet 310 along the average direction of the diverting force F, is brought into contact with at least a part of the guide surface 420. It is clear that similarly as explained above the guide surface 420 in this way, will limit the distance 430 travelled by the fluid jet (310), especially the component of the fluid jet 310 along the average direction of the diverting force F of the fluid jet 310.

As further shown in FIGS. 1 to 4, according to such an embodiment, the apparatus further comprises suitable sensors 610, 620 which are suitably coupled to a controller 600 of the apparatus 10. The controller 600 is for example suitably programmed to control the apparatus 10 in function of suitable parameters 612, 622 measured by the sensors 610, 620. According to the embodiment shown, there is provided an infeed thickness sensor 614, which is configured to measure the thickness of the article 20 in its state in the infeed conveyor 100. The measured thickness by the infeed thickness sensor 614, as shown, thus corresponds with the thickness T of the article 20, along a direction transverse to the movement direction D and transverse to the X direction or the direction of the rotation axis of the pulleys 400 of the conveyors 100, 200. According to an exemplary method of operation of the embodiment of the apparatus shown, this measured thickness of the article 20 in the infeed conveyor 100 is input to the controller as an infeed parameter 612 for controlling the apparatus 10. As will be explained in further detail below, according to the embodiment of the apparatus in FIGS. 1-4, the infeed conveyor 100 comprises two opposing belts 122, 124 that are spaced parallel to each other and to the infeed path 110 in such a way that the gap in between them corresponds to or is set in function of the thickness T of the article 20 when conveyed in between these opposing belts 122, 124. Although according to alternative embodiments, adjusting the distance or gap in between the two opposing belts 122, 124 of the infeed conveyor 100 in function of the thickness of the article 20 could be done manually, adjusting this distance or gap automatically in function of the measured thickness 615 provided as in infeed parameter 612 by the infeed thickness sensor 614 to the controller 600 is advantageous, as this allows for adjusting and/or fine-tuning the gap to variations in the thickness of the articles or for automatically processing articles of varying thickness. According to the embodiment shown, the controller 600 is suitably connected to an infeed gap adjustment assembly 630 configured to suitable adjust the distance or gap 126 between the opposing belts 122, 124 to a desired value as calculated by the controller 600 in function of the measured thickness 615 by the infeed thickness sensor 614. The distance or gap between the opposing belts 122, 124, which can be referred to as the infeed gap 126, will be set or adjusted to a desired value which for example corresponds to the thickness T of the article 20 or a smaller suitable value in function of the thickness T of the article, such as for example in the range of 80% up to and including 100% of the thickness T of the article 20. The desired value for the infeed gap 126 should be small enough to allow for sufficient grip of the opposing belts 122, 124 on the opposing outer sides 22, 24 of the article 20 to ensure a reliable positioning and movement of the article 20 along the infeed path 110 in between the opposing belts 122, 124 of the infeed conveyor 100, while allowing the infeed gap 126 to be large enough to allow the article 20 to enter the infeed conveyor 100 at the infeed entry 120. It is clear that depending on the type of article 20 being handled, for example taking into account its elasticity, shape, particular features, fringes, stubbles, . . . or depending on for example a desired level of pre-compression, the infeed gap 126 could be set or adjusted to a desired value which is even a smaller share of the thickness T of the article 20, such as for example any suitable value in the range of 10% up to and including 100% of the thickness T of the article 20.

In order to adjust the infeed gap 126 the infeed gap adjustment assembly 630 is configured to move the second conveyor belt 124 relative to the first conveyor belt 122, in such a way that the distance between the opposing belts 122, 124 at the location of the infeed path 110 is changed. According to the embodiment shown, the infeed gap adjustment assembly 630 comprises a linear actuator 632 at one end 634 mounted to a frame 12 of the apparatus 10 and at the opposing end 636 to a mounting frame 638 for a plurality of pulleys 400 that define the path of the second conveyor belt 124 along the infeed path 110. The linear actuator 632 according to this embodiment is configured to move the mounting frame 638 in such a way that the infeed gap 126 increases or decreases, while the path of the second conveyor belt 124 along the infeed path 110 remains parallel, this means substantially parallel, to the path of the opposing first conveyor belt 122 along the infeed path 110, as for example shown in FIGS. 1-4. In order to maintain the second conveyor belt 124 at the desired tension, as shown, according to this embodiment, there is made use of a tensioner 650, which comprises a pneumatic linear actuator that is actuated or set at a suitable pressure, which is mounted at one end to a frame 12 of the apparatus 10 and which at its opposing movable end comprises a suitable pulley 400 configured to guide the second conveyor belt, which can also be referred to as a tensioner or tensioner roller.

Similarly, as further shown, for example in FIG. 3, when the apparatus 10 is operated according to a method for folded diversion, in which the article 20 enters and proceeds along the outfeed conveyor in a folded state, it is clear that the thickness of the folded article 20 in its state in the outfeed conveyor 200, is larger than the thickness of the article 20 in its unfolded state in the infeed conveyor 100. As shown, according to this embodiment, the thickness of the article in its folded state in the outfeed conveyor 200 is about two times the thickness of the article 20 in its unfolded state in the infeed conveyor 100. It is clear that, in function of the type of the article, its dimensions or material properties, such as the elasticity, roughness, . . . , a desired level of precompression, . . . that another suitable ratio of the thickness of the article 20 in its state in the outfeed conveyor 200 with respect to the thickness in its state in the infeed conveyor 100 is possible, such as for example a suitable ratio in the range of 100% up to and including 300%. Preferably the thickness of the article 20 in its folded state in the outfeed conveyor 200, which corresponds to the distance or gap between both opposing conveyor belts 222, 224, which can also be referred to as the outfeed gap 226, will be set or adjusted to a suitable value that is small enough to allow the article 20 to be sufficiently securely clamped in between both opposing belts 222, 224 for allowing a precise and reproducible control of the position and movement of the article 20 along the outfeed path 210 by means of the outfeed conveyor 200. Additionally, the outfeed gap 226 will also be chosen sufficiently large, such that the article 20 can enter the outfeed conveyor 200 at the outfeed entry 220 reliably, even at high operating speed.

Similarly as explained above, with respect to the infeed conveyor 100, according to the embodiment shown in FIGS. 1-4, the outfeed conveyor 200 comprises two opposing belts 222, 224 that are spaced parallel to each other and to the outfeed path 210 in such a way that the outfeed gap 226 in between them is set or adjusted to a suitable value. According to an embodiment described above, the outfeed gap 226 could for example be set or adjusted in function of the thickness of the article 20 in its state when conveyed along the outfeed path in between these opposing belts 222, 224 of the outfeed conveyor 200. It is clear that alternative embodiments are possible, in which for example the outfeed gap 226 of the outfeed conveyor 200 is set or adjusted in function of the thickness of the article 20 in its state in the outfeed conveyor 200 manually. However, embodiments in which, the outfeed gap 226 is set or adjusted automatically, for example in function of a measured thickness 615 of the article 20 provided as in infeed parameter 612, are advantageous, as this allows for adjusting and/or fine-tuning the outfeed gap 226 to variations in the thickness of the articles or for automatically processing articles of varying thickness, . . . . According to the embodiment shown in FIGS. 1-4, the outfeed gap 226 is set or adjusted automatically by the controller 600 in function of infeed parameter 612 measured by the infeed thickness sensor 614. Similar as explained above the outfeed gap 226 is increased when the thickness measured by the infeed thickness sensor 614 increases, and the outfeed gap is decreased when the thickness measured by the infeed thickness sensor 614 decreases. It is clear that alternative embodiments are possible in which for example, similar as the infeed thickness sensor 614 at the infeed conveyor 100, there is arranged a further outfeed thickness sensor 614 at the outfeed conveyor 200 configured to measure the thickness of the article 20 in its state in the outfeed conveyor 200 directly. However, it is clear that the thickness of the article in its state in the outfeed conveyor 200 can be derived from the thickness of the article 20 measured upstream in the infeed conveyor. According to a still further embodiment, instead of controlling the outfeed gap 226 in function of the thickness of the article 20 directly, the thickness of the outfeed gap 226 could be determined in function of a suitable relation with the infeed gap 126, such as for example a suitable ratio, which is maintained between the infeed gap 126 and the outfeed gap 226. In this way, when the infeed gap 126 is automatically adjusted to the thickness of the article 20 in its state in the infeed conveyor 100, for example in function of measurements by the infeed thickness sensor 614, these adjustments will also be propagated to suitable adjustments to the outfeed gap 226. According to a particular embodiment, the adjustments to the outfeed gap 226 could for example be twice as large as the adjustments to the infeed gap 126, or any other suitable, desired ratio. In order to take into account the progression of the article along the movement direction D, the adjustments to the outfeed gap 226 could be controlled to be executed with a suitable delay, with respect to the adjustments to the infeed gap 126 in order to take into account the time needed for the article 20 of which the thickness is being measured to reach the outfeed conveyor. It is clear that still further embodiments are possible, in which for example instead of making adjustments to the infeed gap 126 and/or the outfeed gap 226 in response to the measurement of the thickness of individual articles 20, the adjustments are made in response to an average or mean or any other suitable calculated value of a plurality of measurements of the thickness of a plurality of articles 20.

Similarly, as already explained above with respect to the infeed gap adjustment assembly, according to the embodiment shown, the controller 600 is suitably connected to an outfeed gap adjustment assembly 640. In this way the outfeed gap adjustment assembly 640 is configured to suitably adjust the outfeed gap 226 to a desired value as calculated by the controller 600 in function of for example the measured thickness 615 by the infeed thickness sensor 614, the infeed gap 126, etc. According to a particular embodiment, the outfeed gap 226 will for example be set or adjusted to a desired value which for example corresponds to twice the thickness T of the article 20 or a smaller suitable value in function of the thickness T of the article 20, such as for example in the range of 160% up to and including 200% of the thickness T of the article 20. The desired value for the outfeed gap 226 should be small enough to allow for sufficient grip of the opposing belts 222, 224 on the opposing outer sides 24A, 26A of the article 20 to ensure a reliable positioning and movement of the article 20 along the outfeed path 210 in between the opposing belts 222, 224 of the outfeed conveyor 200, while allowing the outfeed gap 226 to be large enough to allow the article 20 to enter the outfeed conveyor 200 at the outfeed entry 220. It is clear that depending on the type of article 20 being handled, for example taking into account its elasticity, shape, roughness, particular shape, features, fringes, stubbles, . . . or depending on for example a desired level of pre-compression, the outfeed gap 226 could be set or adjusted to a desired value which is even a smaller share of the thickness T of the article 20, such as for example any suitable value in the range of 40% up to and including 200% of the thickness T of the article 20. It is clear that according to alternative embodiments, in which for example the outfeed gap 226 is determined by the controller 600 in function of the infeed gap 126, the outfeed gap adjustment assembly 640 could be controlled by the controller 600 to set or adjust the outfeed gap 226 to a value in the range of 80% up to and including 300% of the infeed gap 126, for example 150% up to and including 250%, preferably 160% up to and including 200% of the infeed gap 126.

Similarly as explained above with reference to the infeed gap adjustment assembly, in order to adjust the outfeed gap 226 the outfeed gap adjustment assembly 640 is configured to move the second conveyor belt 224 relative to the first conveyor belt 222, in such a way that the distance between the opposing belts 222, 224 at the location of the outfeed path 210 is changed. According to the embodiment shown, the outfeed gap adjustment assembly 640 comprises a linear actuator 642 at one end 644 mounted to a frame 12 of the apparatus 10 and at the opposing end 646 to a mounting frame 648 for a plurality of pulleys 400 that define the path of the second conveyor belt 224 along the outfeed path 210. The linear actuator 642 according to this embodiment is configured to move the mounting frame 648 in such a way that the outfeed gap 226 increases or decreases, while the path of the second conveyor belt 224 along the outfeed path 210 remains parallel, this means substantially parallel, to the path of the opposing first conveyor belt 222 along the outfeed path 210, as for example shown in FIGS. 1-4. In order to maintain the second conveyor belt 224 at the desired tension, as shown, according to this embodiment, there is made use of a tensioner 652, which comprises a pneumatic linear actuator that is actuated or set at a suitable pressure, which is mounted at one end to a frame 12 of the apparatus 10 and which at its opposing movable end comprises a suitable pulley 400 configured to guide the second conveyor belt, which can also be referred to as a tensioner or tensioner roller. It is clear that alternative embodiments of tensioners could be used, such as for example mechanical, hydraulical, electrical, . . . tensioners, that make use of a suitable controllable and/or adjustable force generating element, such as for example a suitable spring, piston, motor, actuator, etc., for maintaining the required tension in the second conveyor belt 224.

The embodiment of the infeed and outfeed gap adjustment assembly 640, as for example shown in FIGS. 1-4, is advantageous, as the movement of the belt guiding pulleys 130 or rollers which are mounted on the mounting frame 638, 648 is limited to a suitable movement to adjust in order to compensate for changes in the smallest dimension of the shape article 20, namely its thickness 615 in its state in the infeed conveyor 100 or its thickness 625 in its state in the outfeed conveyor 200. The corresponding changes to the path of the belt during such adjustments, that need to be compensated by the tensioner, also remain limited, typically less than two to three times the article thickness T.

According to the embodiment shown, the infeed thickness sensor 614, is embodied as sensor which measures the thickness of the article by for example contacting with a suitable contactor, a planar side 22 of the article 20 at a predetermined location along the infeed path 110. As shown, at this location the opposing planar side 24 of the article 20 is for example supported by a suitable belt 122 and/or roller or pulley of the infeed conveyor 100. It is clear, that the thickness 615 of the article 20 can be determined from the distance between the contactor of the infeed thickness sensor 614 and the pulley, belt, roller or other suitable supporting or guiding element supporting the opposing side of the article 20. It is clear that other suitable sensors could be used as thickness sensor 614, such as for example any other suitable sensor for determining the distance between a planar side of the article and a support element for its opposing planar side, or a sensor measuring directly the distance between both opposing planar sides of the article. It is clear that such a sensor 614 could for example be of the type that makes contact with the article such as for example a suitable linear or rotary encoder coupled to a movable arm that contacts the planar side of the article with a suitable contactor, such as for example a little roller, when the article passes at the location of the sensor 614, or any suitable non-contact thickness sensor, such as for example a suitable optical sensor that measures the distance between the sensor and the planar side facing the sensor, thereby deriving the thickness of the article, or an optical sensor, such as for example a suitable image sensor, array of photosensors, . . . that determines the thickness of the article directly by analyzing an image or other suitable representation of the view of the side of the article from which the thickness can be determined.

It is clear that, according to the embodiment shown, and as described above, the infeed thickness sensor 614 is configured to determine both an infeed parameter 612 related to the thickness 615 of the article 20 in its state in the infeed conveyor 100 and an outfeed parameter 622 related to the thickness 625 of the article 20 in its state in the outfeed conveyor 200. It is clear that alternative embodiments are possible, in which for example a plurality of sensors 610, 620 are used, for example one or more thickness sensors configured to determine the thickness 615 of the article 20 in its state in the infeed conveyor 100 and/or one or more sensors to determine the thickness 625 of the article 20 in its state in the outfeed conveyor 200. Or in other words, according to alternative embodiments, the apparatus 10 comprises at least one sensor to determine an infeed parameter, such as the thickness of the article in its state in the infeed conveyor; and/or at least one sensor to determine at least one outfeed parameter, such as the thickness of the article in its state in the outfeed conveyor.

According to the embodiment show in FIGS. 1-4, optionally the apparatus could comprise further sensors 610, 620 suitable coupled to the controller 600. As shown, the embodiment of the apparatus 10, comprises for example three optical sensors 660, 670, 680 configured to detect the presence and/or absence of an article at a predetermined position along the infeed path 110 and/or the outfeed path 210. According to the embodiment shown, the optical sensor 660, 670, 680 for example comprises a suitable detector that is able to determine the presence or absence of an article by means of the detection of interrupted or reflected light from a suitable light source. According to one embodiment such optical sensors 660, 670, 680 could for example be embodied as a suitable light curtain, photo-electric sensors, photocells, laser sensors, etc. According to such embodiments, typically, the photo-electric sensor emits a suitable light beam used to detect the presence or absence of the articles by detecting whether the emitted light is interrupted or reflected by the articles by means of a suitable detector. It is clear that different embodiments of photo-electric sensors are possible, which for example make use of a reflector or without a reflector, and in which for example the light source and/or the detector could be arranged at the same side of the article and/or at opposite sides of the article, etc.

A first optical sensor 660, which for example is embodied as a light curtain, detects the presence of the article 20 at or near the infeed entry 120. The sensor 660 for example is configured to detect the presence of the article 20 by means of a detection of an interruption a light beam by the article 20. It is clear that when the article 20 is fed along the infeed path 110 at the infeed entry 120 of the infeed conveyor, this sensor 660 will for example be able to detect the presence of the upstream end 26 of the article 20, by the interruption of the light beam. Subsequently, as the article 20 progresses along the movement direction D past the position of the infeed path 110 at the infeed entry 120 monitored by the first optical sensor 660, the continued presence of the article 20 will be detected by a continued interruption of the light beam. Then, when the downstream end 28 of the article 20 passes this position monitored by the sensor 660, the sensor will be able to detect this downstream end 28 of the article 20, as the light beam will no longer be interrupted. It is clear that in this way the sensor 660 will enable the controller 600, based on such signals to for example determine suitable infeed parameters of the shape and/or state of the article 20 in the infeed conveyor 100. It is clear that in this way for example the position of the article 20 along and/or with respect to the infeed path 110 can be determined, more specifically detection of the article 20 and/or its up-stream and/or down-stream ends at the position of the sensor 660 near the infeed entry 120 allow the controller 600 to determine the presence, and position of a new article 20 being fed to the apparatus 10. This is advantageous, as the apparatus 10 in this way is able to function as an independent modular unit in an assembly line, and increases flexibility of the apparatus, as it is able to take into account any changes in the infeed of new articles, such as their frequency, distance and/or time between successive articles, variations in the length, type, orientation, etc. of the articles, etc. by adjusting the subsequent operations of the apparatus to the infeed parameters 612 related to the shape and/or state of the article in the infeed conveyor 100 as for example determined by a suitable sensor such as described above. It is further clear that further infeed parameters 612, such as for example the distance between the upstream and downstream end of the article 20 or its length can be determined by the controller 600, when combining the measurements of this sensor 660 with the speed of movement along the infeed path 110 as controlled or monitored by the controller 600. As will be described in further detail below, this is advantageous, as in this way the controller 600 will be able to suitably adjust the control of the apparatus 10 in order to for example take into account any variations in the length or position of the article 20. In this way, the controller 600 will be able to make the desired adjustments by controlling the timing and/or duration of the fluid jet 310 emitted by the diverter 300 in function of the position of the article 20 along and/or with respect to the infeed path 110. When for example, it is desired to operate the apparatus 10 for an operation of folded diversion in which it is desired to fold the article 20 in half. The detection and determination of the position of the upstream end of the article is for example important to time the fluid jet 310 emitted by the diverter 300 in such a way that a suitable zone 37 of the article 20 downstream of the upstream end 26 of the article 20 in its state in the infeed conveyor 100 is impacted by the fluid jet 310 and the upstream end 26 of the article 20 is not impacted by the fluid jet 310. For example, this will further enable the controller 600 to adjust the relative position of this zone 37 of the article 20 impacted by the fluid jet 310 with respect to the upstream end 26 of the article 20 in function of variations in the length L of the article 20 as for example determined by means of sensor 660, such that for example position of the zone 37 impacted by the fluid jet 310 results in a folded diversion in which the article is folded in half as desired, even when there are variations in the length of the article 20, variations in the distance between two successive articles 20, etc.

As further shown in FIGS. 1-4, according to this embodiment, the apparatus 10 comprises a second optical sensor 670 arranged at a position near the infeed exit 140 and configured to detect the article 20 when arriving at the infeed exit 140. According to the embodiment shown, the optical sensor 670 detects the article 20 at a position which is also at or near the outfeed entry 220 and/or at or near the position where the fluid jet 310 impacts the article 20 when ejected by the diverter 300. According to the embodiment shown, the sensor 670 detects the article in a position at the infeed exit 140 upstream with respect to the position at which the fluid jet 310 impacts the article 20. It is clear that similar as described above, this second sensor 670, allows to detect the presence of the article 20 and/or the presence its upstream and/or downstream end at this position and thereby allow the controller 600 to determine similar or further infeed parameters 612 for example to control the timing of the fluid jet 310 by the diverter 300. For example, upon detection of the arrival of the upstream edge of the article 20, and for example the length of the article 20 as previously determined by the controller 600 based on the measurements of the first sensor 660, the controller 600 will be able to set or adjust the timing in such a way that the fluid jet impacts the desired zone of the article 20 with respect to its upstream end as it progresses along the direction of movement D out of the infeed exit 140. In this way the desired diverting operation, for example a folded diversion operation as shown in FIGS. 1-15, can be realized in which the desired position of the folding line of the article 20 can be reliably determined. Alternatively, when the optical sensor, as shown, is arranged to detect the planar side impacted by the fluid jet, and for example the optical sensor is also able to detect the distance of this planar side with respect to the sensor 670, it is also possible for the controller 600 to detect and monitor the diversion of the article 20 from the infeed path 110 to the outfeed path 210 by means of the diverter 300.

As further shown, according to this embodiment, the apparatus 10 further comprises a third optical sensor 680 arranged near or at the outfeed exit 240. Similar as described above, this sensor 680 is for example configured to detect the presence of the article 20 at this position along the outfeed path 210, or to detect the upstream end or the downstream end of the article 20 in its state in the outfeed conveyor 200. It is clear that, similar as described above for the infeed parameters, the controller 600, based on these sensor 680 measurements, will be able to determine outfeed parameters 622 related to the shape and/or state of the article 20 in the outfeed conveyor 200. Also, these outfeed parameters 622 will then enable the controller 600 to set or adjust the operation of the apparatus in function of desired outfeed parameters 622. According to a similar example as already mentioned above in which the desired operation of the apparatus 10 is a folded diversion of the article 20 in half, then a suitable outfeed parameter 622 for the controller as determined by this sensor 680 could be the length of the article 20 in its state in the outfeed conveyor 200. This outfeed parameter 622 could be determined by the controller 600 by means of the detection of the upstream and downstream end of the article 20 as it progresses along the movement direction D past the position of the sensor 680 when combining the measurements of this sensor 680 with the speed of movement along the outfeed path 210 as controlled or monitored by the controller 600. The controller 600 will then be able to control the operation of the apparatus 10 in such a way that for example a desired outfeed parameter 622 like the length of the article 20 in its state in the outfeed conveyor 200 is obtained. According to the example mentioned above in which it is desired to fold the diverted article in half, the desired outfeed parameter 622 could for example be determined as half of the infeed parameter 612 that determined the length of this article 20 in its state in the infeed conveyor 100, as folding the article 20 in half will result in a halving its length along the direction of movement D as shown in the Figures. It is clear that in such an operation, the controller 600 could for example be configured to control the apparatus 10 in function of a desired ratio of the outfeed parameter 622 of the length of the article in the outfeed conveyor with respect to the infeed parameter 612 of the length of the article in the infeed conveyor. In the example above, where it is desired that the diverted articles 20 are folded in half, the ratio between the length in the outfeed conveyor and the length in the infeed conveyor of the article along the movement direction could for example be 50%. It is clear that a divergence of the output parameter or such a ratio with respect to the desired output parameter, or desired ratio can then be used to adjust the operation of the apparatus 10 for example by adjusting the timing and/or duration of the fluid jet 310 ejected by the diverter 300, the speed of the movement of the article 20 in the infeed or outfeed conveyor, etc. According to still further alternative embodiment, the third optical sensor 680 could be used by the controller 600, to verify that the article was correctly and successfully diverted after activation of the diverter 300, and/or whether the diverted article 20 correctly proceeded along the outfeed conveyor to arrive at the outfeed exit 240, thereby enabling for example detection of a blockage, malfunction, damaged article, etc.

It is clear that alternative embodiments are possible, for example in which a different number of optical sensors 660, 670, 680 could be provided, such as for example only a sensor configured to determine the length of the article 20 in its state in the outfeed conveyor 200. In such a case, when the length of the article 20 in the infeed conveyor 100 is for example set to a predetermined value, then the controller 600 will be able to determine whether the desired outfeed parameter is achieved and if needed set or adjust the apparatus 10 in a suitable way. It is clear that still further alternative embodiments are possible and that still further alternative sensors, or a plurality of sensors could be used for determining infeed parameters and/or output parameters related to the shape of the article 20 in the infeed conveyor and the outfeed conveyor respectively. According to such an embodiment, there could be made use of one or more cameras to determine the shape and state of the articles 20 at one or more positions in or at the infeed and/or outfeed conveyor. Suitable automated image analysis could then be used to determine from the images captured by the suitable camera similar infeed and outfeed parameters as described above, such as for example the thickness of the article, length of the article, position of the article, position of the upstream and downstream end of the article, etc. It is clear that according to the embodiment shown in FIGS. 1-4 in which the articles 20 are conveyed in between opposing conveyors, preferably the camera images are taken from a direction that allows a view similar to that of FIG. 1, or in other words a view along the direction of the rotational axis of the pulleys of the conveyors, or at an acute angle with respect to this direction, as this allows for the most clear identification of the state and position of the article at positions in, at or near the infeed and outfeed conveyor, without being obscured by the conveyor belts in between which the articles are conveyed.

It is clear that still other types of sensors 610 could be used in according to further alternative embodiments such as for example suitable image sensors, three-dimensional camera's or image sensors, or distance sensors, length sensors, edge detection sensors, which do not necessarily need to be optical sensors. It is clear that such sensors 610, for example similar as described above would enable the controller 600 to control the apparatus 10 in function of similar parameters such as described above with respect to the shape and/or state of the article in the infeed and/or outfeed conveyor, such as for example the thickness of the article, length of the article, the position and/or distance between the upstream and downstream end of the article, the position of the article, etc.

It is clear that still further alternative embodiments are possible, for example, in which in general the apparatus 10 further comprises at least one sensor 610 configured to determine at least one infeed parameter 612 related to the shape/and or state of the article 20 in the infeed conveyor 100; and/or at least one sensor 620 configured to determine at least one outfeed parameter 622 related to the shape and/or state of the article 20 in the outfeed conveyor 200. The controller 600 is then suitably coupled to said at least one sensor 610, 620 and configured to control said apparatus 10 in function of at least one desired infeed parameter 612 and/or at least one desired outfeed parameter 622. Or alternatively or additionally the controller 600 is configured to control said apparatus 10 in function of a desired ratio of at least one desired outfeed parameter 622 with respect to at least one desired infeed parameter 612.

According to the exemplary embodiment shown in FIGS. 1-15, the apparatus 10 is configured to perform an operation which can be referred to as folded diversion. According to such a method of operation, as shown, the article 20 in its state in the infeed conveyor arrives at the diverter, upon which it enters the outfeed conveyor in a folded state under the controlled action of the diverter 300. According to such an embodiment the timing and/or duration of the fluid jet 310 emitted by the diverter 300 is controlled by the controller 600 in such a way that when a zone 37 of the article 20 downstream of the upstream end 26 of the article 20 in its state in the infeed conveyor 100 is impacted by the fluid jet 310 and the upstream end 26 of the article 20 is not impacted by the fluid jet 310. In other words, the zone 37 of the article 20 impacted by the fluid jet 310 is located at a predetermined distance 39 downstream of the upstream end 26 of the article 20, when seen along the direction of movement D. As for example shown in more detail in FIG. 17, along the direction of movement D, the zone 37 of the article 20 that is impacted by the fluid jet 310 when it passes by the activated diverter 300 is arranged at a predetermined distance 39 from the upstream end 26 of the article 20. As for example shown in FIGS. 1-15, and more particularly the sequential method steps as shown in FIGS. 5 to 15 for this particular embodiment, this means that, even when the article 20 is being diverted by the diverter 300, the article 20 coming out of the infeed exit 140 continues with its upstream end 26 past the diverter 300 and the outfeed entry 220 along the infeed path 110 without being impacted by the fluid jet 310. As further shown, it is only when the upstream end 26 of the article 20 has continued past the diverter 300 along the movement direction D along that predetermined distance 39, that the fluid jet 310 starts to impact the article 20. Subsequently, while the article 20 continues to be provided at the infeed exit 140 along the movement direction D, and continues to be impacted by the fluid jet 310, it is clear that the length 37L of the zone 37 of the article 20 which is or has been impacted by the fluid jet 310 increases in the direction of the downstream end 28 of the article 20 until the diverter 300 ends the fluid jet 310. Although the zone 37 impacted by the fluid jet 310 could continue up to and including the downstream end 28 of the article 20, preferably, as shown, the fluid jet 310 of the diverter 300 is ended before the downstream end of the article 20 passes at the position of the fluid jet 310. In other words, the zone 37 of the article 20 impacted by the fluid jet 310, along the movement direction D preferably ends before the downstream end 28 of the article 20. This thus means that, along the movement direction D, subsequent to the zone 37 impacted by the fluid jet 310, there is a subsequent further downstream zone 44 of the article 20, which, similar as the upstream zone 42, is not impacted by the fluid jet 310. Such an embodiment is advantageous, as this limits the amount of fluid consumption of the diverter 300 for performing the folded diversion operation. It is thus clear, that the controller 600 of the apparatus is configured to control the timing and duration of the fluid jet 310 emitted by the diverter 300 to realize the desired zone 37 of the article 20 along the direction of movement D to be impacted by the fluid jet 310 and other zones 42, 44 of the article 20 not to be impacted by the fluid jet 310. It is further clear that the controller 600 will control the timing and the duration of the fluid jet 310, taking into account the position and/or speed of the article 20 along or with respect to the infeed path 110 or the outfeed path 210. As shown most clearly in this way in FIGS. 3 to 4, the article 20 will be folded about a folding line 27 that forms the upstream end 26A of the article 20 when it enters the outfeed entry 220 of the outfeed conveyor 200. It is thus clear that, according to this embodiment, diverter 300 is controlled such that the fluid jet 310 impacts the zone 37 of the article 20 at least until the folding line 27 has securely entered the outfeed entry 220 and preferably the fluid jet 310 is ended as soon as possible thereafter in order to reduce fluid consumption by the diverter 300. As further shown, the fluid jet 310 according to this embodiment, preferably impacts the impact zone 21 of the article 20 at the infeed exit 140, upstream of the outfeed entry 220. As shown, this means that the fluid jet 310 is controlled such that impacts the article 20, when the folding line 27 is still upstream of the outfeed entry 220, and continues to impact the impact zone of the article 20 at least until the folding line 27 reaches the outfeed entry 220 and can be further conveyed along the outfeed path 210 by the outfeed conveyor 200. Preferably the zone 37 of the article 20 impacted with the fluid jet 310 during the folded diversion operation, when the article 20 moves along the movement direction D, starts at, or substantially at the position of the folding line 27 and ends downstream thereof. Preferably the length 37L along the movement direction D of this zone 37 impacted by the fluid jet 310 while the article 20 moves from the infeed exit 140 to the outfeed entry 220 is limited as much as possible, and is preferably less than 30% of the length of the article 20, for example in the range of 2% to 10% of the length of the article 20, for example 5%. It is further clear that the zone 37 impacted by the fluid jet 310 is larger than the impact zone 21 of the article 20 as shown, as the article 20 being diverted is moved along the direction of movement D, and this thus causes the impact zone 21 to shift along the article 20 correspondingly in a direction opposed to this direction of movement D or in other words towards the downstream end of the article 20. It is further clear that the article 20, during the time period it is impacted by the fluid jet 310 from the diverter 300 continues its movement along the direction of movement D, whereby the part 21 of the article 20 impacted by the fluid jet 310 is diverted from the infeed path 110 and proceeds to the outfeed entry 220 of the outfeed conveyor 200 in such a way that the folding line 27 enters the outfeed entry 220 as the upstream end 26A of the article 20 in its folded state in the outfeed conveyor 200. It is clear that the timing of the fluid jet 310, especially the timing of the fluid jet 310 that defines the length 39 of the upstream zone 42 not impacted by the fluid jet 310 can be controlled to flexibly control the position of the folding line 27 during a folded diversion operation as described above. If desired, the position of the folding line 27, for example with respect to the upstream or downstream end of the article, or as a ratio of the length of the article in its state in the infeed conveyor can thus be instantly set or adjusted during operation of the apparatus 10, even for each individual article 20 arriving at the diverter 300.

Figure 17:
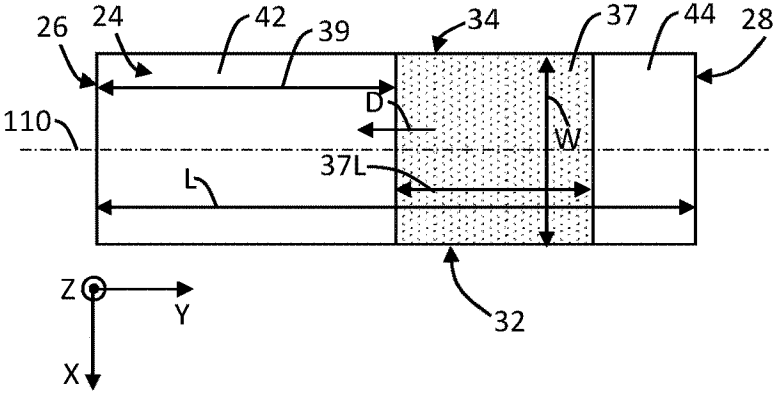
FIGS. 16-19 schematically show different embodiments and/or states of articles suitable for being diverted and/or folded by embodiments of the apparatus and/or the method of operating such an apparatus.

It is clear that alternative operations to the folded diversion operation described above, and of which a top view of the article 20 in its state in the infeed conveyor 100 is shown in FIG. 17, are possible by controlling the timing and/or duration of the fluid jet 310 emitted by the diverter 300 in function of the position of the article 20 along and/or with respect to the infeed path 110 and/or the outfeed path 210. Such an alternative operation is for example unfolded diversion, as for example schematically illustrated in FIG. 16. According to such an operation, when diverted by the diverter 300, the article continues in the same state along the outfeed conveyer 200 as its state in the infeed conveyor 100, or in other words the upstream end, downstream end, length, shape, etc. of the article in the outfeed conveyor 200 when seen along the direction of movement D is the same as in the infeed conveyor 100. For realizing this unfolded diversion operation, the fluid jet is controlled such that a zone 36 of the article 20 comprising the upstream end 26 of the article 20 in its state in the infeed conveyor 100 is impacted by the fluid jet 310. As shown, the timing of the fluid jet is such that already the upstream end 26 of the article 20 is impacted and diverted from the infeed path 110 when exiting the infeed exit 140 towards the outfeed entry 220. Similar as described above preferably the duration of the fluid jet 310 is minimized such that fluid consumption can be minimized, but preferably the allows the article 20 to be impacted by the fluid jet 310 until the upstream end 26 of the article 20 has securely entered the outfeed entry 220 and the article 20 is conveyed further by the outfeed conveyor along the movement direction D. In other words, although the zone 36 of the article 20 impacted by the fluid jet 310 could stretch from the upstream end 26 along the entire length of the article 20 to its downstream end 28, preferably the length of the zone 36 along the direction of movement D will be less than 30% of the length L of the article 20, for example 2% to 10% of the length of the article 20, for example 5%. It is clear that in accordance with such an embodiment of unfolded diversion the thickness of the article 20 in both the infeed and outfeed conveyor remains the same. Such an unfolded diversion operation could for example to selectively let articles move further along the infeed path 110 or divert them to the alternative outfeed path 210.

Figure 18:
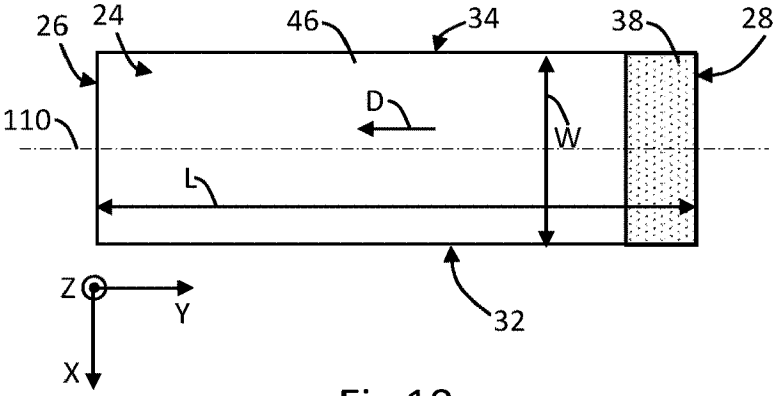

According to still a further embodiment a reversing diversion operation can be realized, such as for example schematically shown in FIG. 18. According to such a reversing diversion operation the downstream end 28 of the article 20 when in the infeed conveyor is inserted into the outfeed entry 220 of the outfeed conveyor 200 as the upstream end 26A of the article 20 in its state in the outfeed conveyor 200. In order to realize this the timing and duration of the fluid jet 310 is controlled such that only a suitable zone 38 comprising the downstream end 28 of the article 20 in its state in the infeed conveyor 100 is impacted by the fluid jet 310. Or in other words, along the direction of movement of the article 20, there is a zone 46 from its upstream end 26, up till this downstream zone 38 at the downstream end 28, which is not impacted by the fluid jet 310. As shown, the length of the zone 38 impacted by the fluid jet 310 along the movement direction of the article 20 is limited, such that the downstream end 28 is the part of the article 20 that reaches the outfeed entry 220 of the outfeed conveyor first and no folding line is created upstream of this downstream end 28. Typically, the length of the zone 38 at the downstream end 28 impacted by the fluid jet will be 10% or less, for example in the 5% or less of the length of the article 20 along the direction of movement D.

Figure 19:
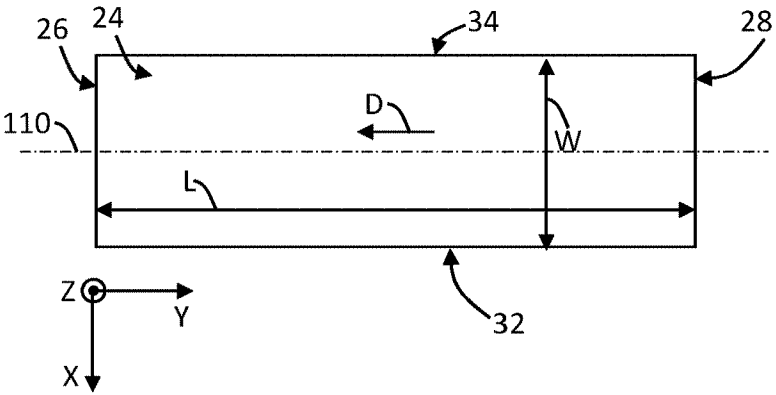
Figure 16:
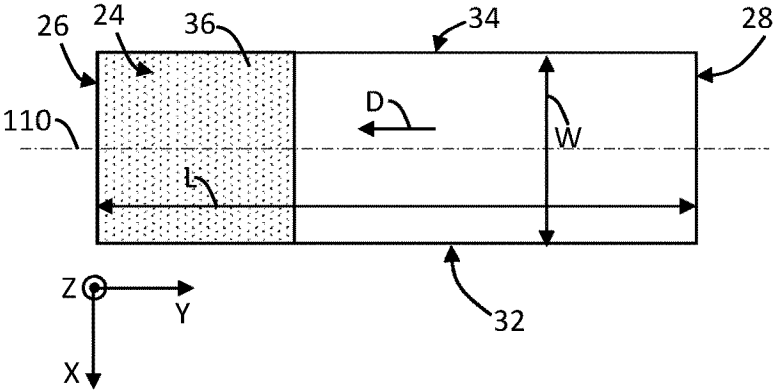

According to still a further embodiment, as shown in FIGS. 19, a further operation is possible that can be referred to as no diversion. In order to realize this, the timing and duration of the fluid jet 310 is controlled such that the article 20 is not impacted by the fluid jet 310, thereby allowing the article to continue along the infeed path 110 from the infeed exit 140 past the outfeed entry 220 without entering the outfeed entry 220. Such an operation is for example useful when for example rejecting defective articles, or allowing articles to selectively continue along the infeed path, etc. In other words, according to this operation there is no zone of the article that is impacted by the fluid jet 310.

It is clear that the timing and duration of the fluid jet 310 of the diverter 300 can be controlled by the controller 600 of the apparatus 10 in such a way that any suitable sequence or combination of such operations can be realized when processing a sequence of articles 20 by the apparatus 10.

It is clear that the controller 600 of the apparatus 10 could for example make use of suitable input parameters 612 as determined by suitable sensors 610, for example as described above, for determining the position of the upstream or downstream end of the article, the length of the article, etc. in its state in the infeed or outfeed conveyor respectively for determining the timing and duration of the fluid jet 310 of the diverter, such that the desired corresponding zones of the article along the direction of movement D can be impacted by the fluid jet 310 to realize the desired operation as for example described above. In this way, while the article 20 moves along the diverter 300, as it is conveyed by the infeed conveyor and/or the outfeed conveyor, the position and length of the zone 36, 37, 38 of the article 20 impacted by the fluid jet 310 can be controlled reliably.

As for example shown in the embodiment of FIGS. 1-15 and 17, in which a folded diversion operation is shown, it is clear that as the article 20 comes out of the infeed exit 140 of the infeed conveyor 100, the upstream end 26 of the article 20 moves further along the infeed path 110 past the outfeed path 210 without being impacted by the fluid jet 310. When the article 20 subsequently reaches a position in which the zone 37 to be impacted by the fluid jet 310 is in a suitable position to be subjected to the diverting force F of the fluid jet 310 of the diverter 300, the diverter 300 will eject a suitable fluid jet 310 thereby starting to divert the article 20 at the impact zone 21, which will be located at a desired distance from the upstream end 26 of the article 20 that continues its movement along the movement direction D as the downstream part of the article 20 continues to be conveyed by the infeed conveyor 100 out of the infeed exit 140. It is clear that, now that the zone 37 impacted by the fluid jet 310 will start to move along the movement direction D towards the outfeed entry 220, in such a way that when entering the outfeed entry 220 there is formed a folding line 27 as described above, which forms the upstream end 26A of the article 20 in its folded state in the outfeed conveyor 200. As shown for example in most detail in FIGS. 3 and 4, at this point in time, the part of the article 20 upstream of this folding line 27 needs is experiencing a deceleration and subsequently a reversing motion which results in inertial forces acting on this part of the article 20, especially when the apparatus 10 operates at high speeds and processes articles 20 at a high frequency. IN order to minimize these inertial forces and reduce the potential for damage or a reduced level of control of the article 20, even when operating at high speeds, preferably, as for example shown in the embodiment of FIGS. 1-15, the apparatus 10 comprises a suitable braking pulley 520, which is arranged, as shown downstream of the infeed exit 140 along the infeed path 110 and also downstream of the outfeed path 210, when seen along the infeed path 110. As described above, infeed conveyor comprises two opposing conveyor belts 122, 124, which together with their pulleys form respectively two opposing conveyor belt assemblies. Similarly also the outfeed conveyor comprises two such opposing conveyor belt assemblies according to the embodiment shown in FIGS. 1-4. According to the embodiment shown, the braking pulley 520 is part of a second conveyor belt assembly of the outfeed conveyor 200. This second conveyor belt assembly is positioned opposite to the first conveyor belt assembly of the outfeed conveyor 200, which as mentioned above, according to this embodiment comprises a common conveyor belt 440 with the infeed conveyor 100. The braking pulley 520, as shown is arranged opposite to the common pulley 400 at opposing sides of the outfeed path 210, and in this way, as shown, the braking pulley 520 and the common pulley 400 are part of the outfeed entry 220 of the outfeed conveyor 200. It is clear that the braking pulley 520 is positioned further away from the infeed exit 140 than the common pulley 400, or in other words, when seen along the infeed path 110 is positioned further downstream, at an opposing side of the outfeed path 210 than the common pulley 400. It is clear that according to the embodiment shown, the braking pulley 520 cooperates with the other pulleys of the second conveyor belt assembly to define a trajectory for the second conveyor belt 224 of the outfeed conveyor along the infeed path 110 downstream of the infeed exit 140, and along the infeed path 110 downstream of the outfeed entry 220, in such a way that the article 20, when the diverter is not activated can continue along the infeed path 110 out of the infeed exit 140, without being braked by the braking pulley 520 and/or its conveyor belt assembly, and when the diverter 300 is activated and diverts the article 20 towards the outfeed entry 220, at least a part of the article 20 downstream of the outfeed entry 220 along the infeed path 110 is brought into contact with the braking pulley 520 and/or its conveyor belt assembly in such a way that this part of the article 20 is braked and/or accelerated in a direction opposite to its direction of motion along the infeed path 110 when it exited the infeed exit 140. It is thus clear that, according to this embodiment the braking pulley and the part of the conveyor belt that brakes this art of the article 20 as described above determine a braking surface 510 of this embodiment of the brake assembly 500. It is however clear that alternative embodiments are possible for such a brake assembly 500 in which the braking pulley 520 determines at least a part of the braking surface 510, for example where the braking pulley 520 is simply a roller arranged at a similar position at the outfeed entry 220 and for example does not define the path of a conveyor belt, but directly contacts the article similarly as described above to brake the part of the article in a similar way. It is clear that still further embodiments are possible in which such a braking surface 510 is for example defined by a suitable friction surface or other suitable element configured to decelerate a similar part of the article as described above. In general, such embodiments of the brake assembly 500 thus comprise a braking surface 510 arranged along the infeed path 110 downstream of the infeed exit 140 of the infeed conveyor 100. Further this braking surface 510 is also arranged along the infeed path 110 downstream of the outfeed entry 220 of the outfeed conveyor 200. Such a braking surface then functions in such a way that when the article 20 is not diverted by the diverter 300, the article 20 is allowed to continue along the infeed path 110 downstream of the infeed exit 140. If or when at least a part of the article 20 is diverted by the fluid jet 310, the braking surface contacts at least a part of the article 20 along the infeed path 110 downstream of the outfeed entry 220. In this way the braking surface will decelerate this part of the article 20 in a direction away from the infeed exit 140. It is clear that according to some embodiments, similar as described above, the braking surface could comprise a suitable active element that also accelerates this part of the article 20 in a direction towards the outfeed entry 220.

It is clear that, preferably, similar as shown in the embodiments of FIGS. 1-4, the infeed conveyor 100 comprises opposing conveyor belt assemblies respectively comprising opposing conveyor belts 122, 124 along the infeed path 110 in between which the article is conveyed. As mentioned above, the article 20 is conveyed by these opposing conveyor belts 122 which respectively clamp the opposing planar sides of the article in its state in the infeed conveyor in between these opposing conveyor belts 122. Or in other words, according to the view of for example FIG. 1, the top conveyor belt contacts the top planar side of the article, while the opposing bottom conveyor belt contacts the opposing bottom plantar side of the article, and the distance between both conveyor belts, as well as their tension is such that the article is clamped between these conveyor belts, such that a coordinated movement of the conveyor belts moves the article along the infeed path 110 along the movement direction D. Similarly, according to such an embodiment, the outfeed conveyor 200 also comprises opposing conveyor belts 222, 224 along the outfeed path 210 in between which the article 20 is conveyed. Similarly, as described above the article 20 is clamped in between these conveyor belts 222, 222 which contact the opposing planar sides of the article 20 in its state in the outfeed conveyor for conveying it along the outfeed path 210. As already mentioned above, the distance between these opposing belts of the infeed and/or the outfeed conveyor could be suitably adjusted by means of a controller 600 in function of the thickness of the article, which is for example suitably measured by a thickness sensor 614.

According to the embodiment shown in for example FIGS. 1-4, and as mentioned above, the outfeed conveyor 200 comprises two opposing conveyor belts 222, 224 of which the outfeed gap 226 in between these conveyor belts 222, 224 can be adjusted by means of an outfeed gap adjustment assembly 640 in function of the thickness of the article 20 as measured by the infeed thickness sensor 614. It is clear that according to the embodiment shown, means that at the outfeed entry 220, the gap or distance between the opposing conveyor belts 222, 224, which can be referred to as the outfeed entry distance 226 is similarly adjusted as described above in function of the thickness of the article, by the outfeed gap adjustment assembly 640. In this way, according to the embodiment shown, the distance, or gap, between the common pulley 400 and the braking pulley 520 which guide the opposing belts 222, 224 at the outfeed entry 220 is determined by the controller 600 in function of a suitable parameter, such as for example the thickness of the article 20 as measured by a suitable sensor. Such embodiments are advantageous, as the diverter 300 only needs to divert a part of the article 20 impacted by the fluid jet 310 towards the guide surface 420. It is not necessary that the diverter 300, according to such an embodiment of folded diversion realizes and completes the fold of the part of the article 20 at the fold line 27. As clearly shown in FIGS. 3-4, this fold is then completed by the opposing pulleys 400, 520 or rolls which are positioned at the outfeed entry 220 and in between which the diverted part of the article 20 is conveyed such that the fold line 27 is completed. According to the embodiment shown, this thus means that the common pulley 400 and the braking pulley 520 function to create and complete the fold line 27 during entry of the article 20 along the outfeed entry 220, while the diverter 300 only needs to divert the impacted part 21 of the article 20 by the fluid jet over the shorter distance 430 to the guide surface 420. In this way the non-contact fluid emitting diverter 300 is also very suited for articles 20 which do not comprise a pre-made or pre-defined folding line in their state in the infeed conveyor 100.

According to the embodiment shown, the angle 30 between the infeed path 110 at the infeed exit 140 and the outfeed path 210 at the outfeed entry 220 is for example 90°, substantially 90°, for example 90°+/−5°. As shown, such an arrangement allows for a compact and simple arrangement of all components such as the infeed conveyor 100, outfeed conveyor 200, diverter 300, . . . etc. which results in the apparatus consuming a reduced amount of floorspace, while also such an angle 30 is advantageous as it is compatible with and allows for realizing optimal angels 40, 50 of the average direction of the diverting force of the fluid jet 310 with the outfeed path at the outfeed entry and/or the infeed path at the infeed exit as described in more detail below. Such an angle 30 also is suitable for allowing in a simple way the article to clearly and selectively proceed along distinctive paths, such as the infeed path or the outfeed path in function of the activation of the diverter as described in further detail above. However it is clear that alternative embodiments are possible in which the angel 30 between the infeed path 110 at the infeed exit 140 and the outfeed path 210 at the outfeed entry 220 is in the range of 30°-150°, for example 60°-120°, preferably in the range of 80°-100°, such as for example 90°+/−5°. Further as for example shown most clearly in the view of FIG. 4, according to such an embodiment, there are created four quadrants Q1, Q2, Q3, Q4 at the intersection of the infeed path 110 and the outfeed path 210 at the infeed exit 140 and the outfeed entry 220. It is clear that these quadrants each define a different angular section between the infeed path 110 and the outfeed path 210 with respect to the intersection point of the infeed and outfeed path. Similar, as for the embodiment shown, preferably each of these elements reside in a different quadrant: the diverter 300, and more specifically its nozzle 320 from which the jet 310 is emitted, which as shown resides in a first quadrant Q1; the guide surface 420 resides in an opposing quadrant Q3, and more specifically according to the embodiment shown the common pulley 400; a further quadrant Q2 comprises the guide pulley 130 of the infeed conveyor 100 that together with the common pulley 400 defines the infeed outlet 140, or according to the embodiment shown, the guide pulley 130 of the infeed conveyor 100 at the opposing side of the infeed path 110 with respect to the common pulley 400; and still a further quadrant Q4, opposing the latter quadrant Q2, comprises the pulley 500, which together with the common pulley 400 defines the outfeed inlet 220, or according to the embodiment shown, the braking pulley 520 of the outfeed conveyor 200 at the opposing side of the outfeed path 210 with respect to the common pulley 400.

Figure 21:
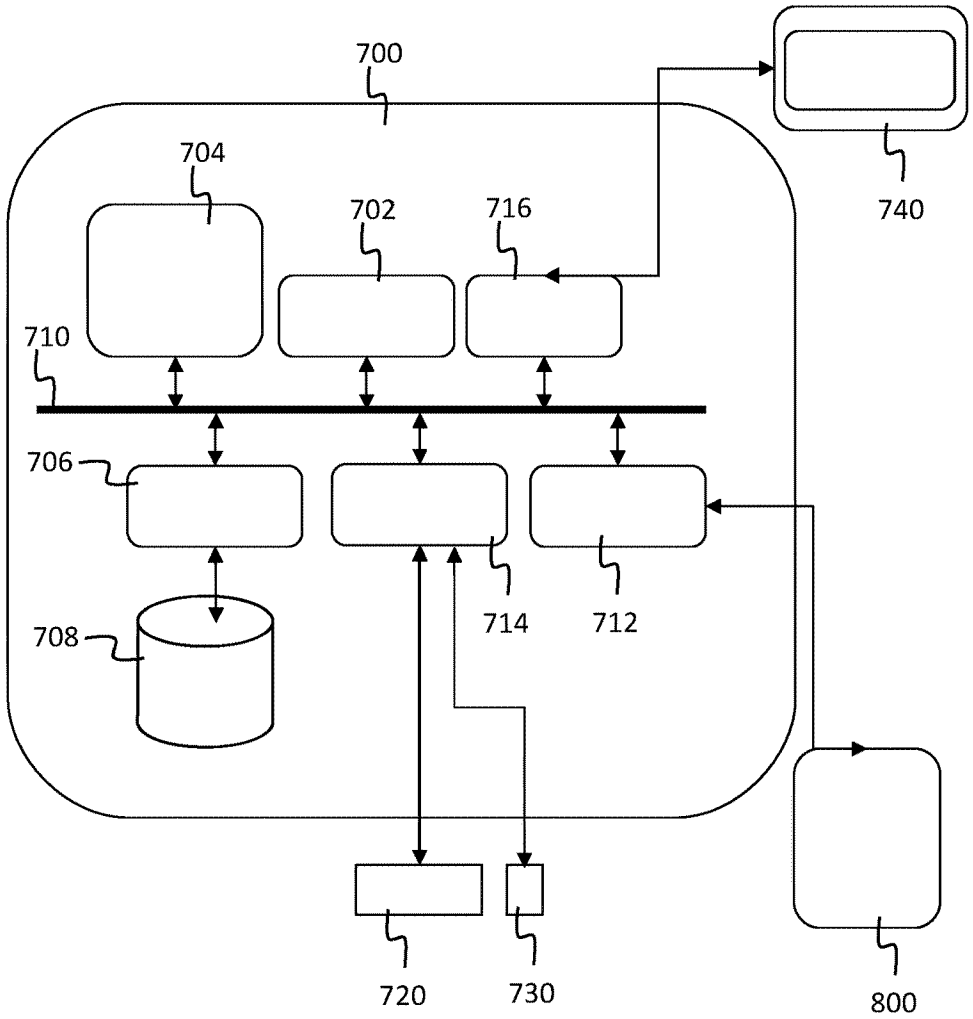
FIG. 21 schematically shows an embodiment a suitable computing system for use in the apparatus according to FIG. 1.
Figure 20:
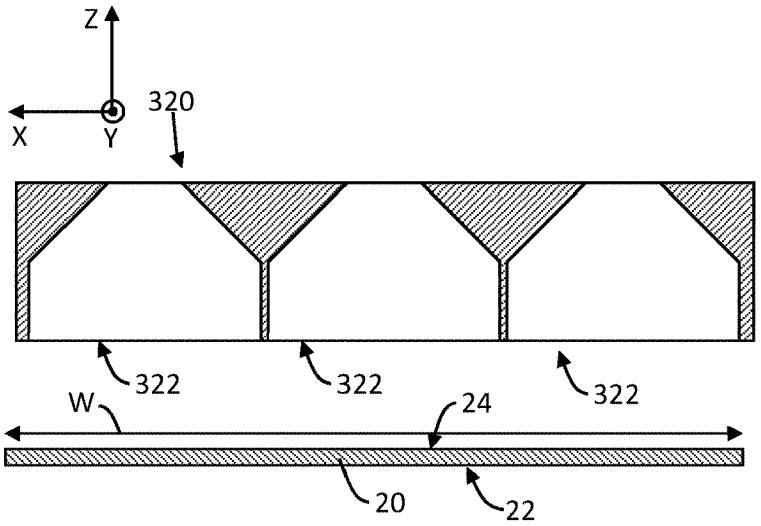
FIG. 20 schematically shows a cross section of an embodiment of an nozzle of such an apparatus.

FIG. 21 schematically shows a suitable computing system 700, 800 for executing some embodiments described above of a method of operating the apparatus as a computer-implemented method. FIG. 21 thus shows a suitable computing system 700, 800 for hosting or implementing a suitable embodiment of the controller of the apparatus, comprising a processor configured to perform such a computer-implemented method or any of its components as described with reference to the above-mentioned embodiments. Computing system 700 may in general be formed as a suitable general-purpose or industrial computer and comprise a bus 710, a processor 702, a local memory 704, one or more optional input interfaces 714, one or more optional output interfaces 716, a communication interface 712, a storage element interface 706 and one or more storage elements 708. Bus 710 may comprise one or more conductors that permit communication among the components of the computing system. Processor 702 may include any type of conventional processor or microprocessor that interprets and executes programming instructions. Local memory 704 may include a random-access memory (RAM) or another type of dynamic storage device that stores information and instructions for execution by processor 702 and/or a read only memory (ROM) or another type of static storage device that stores static information and instructions for use by processor 702. Input interface 714 may comprise one or more conventional mechanisms that permit an operator to input information to the computing device 700, such as a keyboard 720, a mouse 730, a pen, voice recognition and/or biometric mechanisms, a touch sensitive input device, buttons, etc. or to permit the processor to receive input information from sensors of the apparatus. Output interface 716 may comprise one or more conventional mechanisms that output information to the operator, such as a display 740, a printer, a speaker, warning lights, etc., or is configured to provide suitable output signals to control actuators of the apparatus 10. Communication interface 712 may comprise one or more transceiver-like mechanisms such as for example two 1 Gb Ethernet interfaces that enables computing system 700 to communicate with other devices and/or systems, for example mechanisms for communicating with one or more other computing systems 800. The communication interface 712 of computing system 700 may be connected to such another computing system 800 by means of a local area network (LAN) or a wide area network (WAN), such as for example the internet. Storage element interface 706 may comprise a storage interface such as for example a Serial Advanced Technology Attachment (SATA) interface or a Small Computer System Interface (SCSI) for connecting bus 710 to one or more storage elements 708, such as one or more local disks, for example 1 TB SATA disk drives, and control the reading and writing of data to and/or from these storage elements 708. Although the storage elements 708 above is described as a local disk, in general any other suitable computer-readable media such as a removable magnetic disk, optical storage media such as a CD or DVD, -ROM disk, solid state drives, flash memory cards, . . . could be used.

The controller of the apparatus and the associated method, for example according to the above-mentioned embodiments could be part of a suitable ETL utility running on a computing system 700 locally implemented in the apparatus, such as for example a suitable industrial computing system, such as for example a PLC, however it is clear that alternative embodiments, such as for example general purpose computing systems such as a personal computer, laptop, etc. or on a remotely accessible computing system such as one or more servers, are also possible. Alternatively, the controller may also be part of servers controlling a larger assembly line, one or more factory operations, etc., for example comprising web based factory automation utility, configured to operate the apparatus on a scheduled or triggered basis. It is clear that, the controller of the apparatus and the associated computer-implemented method, can be implemented as programming instructions stored in the local memory 704 of the computing system 700 for execution by its processor 702. Alternatively, these components could be stored on the storage element 708 or be accessible from another computing system 800 through the communication interface 712. In general, in this way the controller and associated method of operating the apparatus are provided as a computer program comprising software code adapted to perform this computer-implemented method when executed by a computing system. Alternatively, the controller and the associated computer-implemented method of operating the apparatus could also be provided as a computer readable storage medium comprising computer-executable instructions which, when executed by a computing system, perform the computer-implemented method.

Although the present invention has been illustrated by reference to specific embodiments, it will be apparent to those skilled in the art that the invention is not limited to the details of the foregoing illustrative embodiments, and that the present invention may be embodied with various changes and modifications without departing from the scope thereof as defined in the claims. The present embodiments are therefore to be considered in all respects as illustrative and not restrictive, the scope of the invention being indicated by the appended claims rather than by the foregoing description, and all changes which come within the scope of the claims are therefore intended to be embraced therein.

It will furthermore be understood by the reader of this patent application that the words "comprising" or "comprise" do not exclude other elements or steps, that the words "a" or "an" do not exclude a plurality, and that a single element, such as a computer system, a processor, or another integrated unit may fulfil the functions of several means recited in the claims. Any reference signs in the claims shall not be construed as limiting the respective claims concerned. The terms "first", "second", third", "a", "b", "c", and the like, when used in the description or in the claims are introduced to distinguish between similar elements or steps and are not necessarily describing a sequential or chronological order. Similarly, the terms "top", "bottom", "over", "under", and the like are introduced for descriptive purposes and not necessarily to denote relative positions. It is to be understood that the terms so used are interchangeable under appropriate circumstances and embodiments of the invention are capable of operating according to the present invention in other sequences, or in orientations different from the one(s) described or illustrated above.

The invention claimed is:

1. An apparatus for diverting and/or folding articles comprising an infeed conveyor, an outfeed conveyor, and a diverter, wherein:

the infeed conveyor is configured to convey articles along an infeed path towards an infeed exit, where the articles can exit the infeed path to an outfeed entry of an outfeed conveyor;

the outfeed conveyor is configured to convey the articles along an outfeed path from the outfeed entry, where articles can enter the outfeed path from the infeed exit of the infeed conveyor;

the infeed conveyor and outfeed conveyor are configured such that:

an angle between the infeed path and the outfeed path at the infeed exit and the outfeed entry is in the range of 30° up to and including 150°; and the outfeed entry is positioned adjacent to the infeed path, such that articles can continue along the infeed path downstream of the infeed exit without entering the outfeed entry; and the diverter is configured to divert an article from the infeed path to the outfeed entry of the outfeed conveyor by exhibiting a diverting force on an impact zone of the article at the infeed exit of the infeed conveyor, wherein the diverter is a non-contact, fluid emitting diverter configured to emit a fluid jet to exhibit the diverting force on the impact zone of the article at a side of the article facing away from the outfeed entry; and a brake assembly comprising a braking surface arranged:

along the infeed path downstream of the infeed exit of the infeed conveyor; and along the infeed path downstream of the outfeed entry of the outfeed conveyor, and wherein the braking surface is configured:

when the article is not diverted by the diverter, to allow the article to continue along the infeed path downstream of the infeed exit; and when at least a part of the article is diverted by the fluid jet to contact at least a part of the article along the infeed path downstream of the outfeed entry, such that this part of the article is decelerated in a direction away from the infeed exit and/or accelerated in a direction towards the outfeed entry.

2. The apparatus according to claim 1, wherein the diverter is configured such that:

an angle of the average direction of the diverting force of the fluid jet with the outfeed path at the outfeed entry is in the range of 5°-85°;

an angle of the average direction of the diverting force of the fluid jet with the infeed path at the infeed exit is in the range of 5°-85°; and/or the angle of the average direction of the diverting force of the fluid jet with the outfeed path at outfeed entry and/or the angle of the average direction of the diverting force of the fluid jet with the infeed path at infeed exit are in the range of 40% up to and including 60% of the angle between the infeed path at the infeed exit and the outfeed path at the outfeed entry.

3. The apparatus according to claim 2, wherein the apparatus is configured such that one or more of the following settings of the apparatus:

the angle of the average direction of the diverting force with the infeed path;

the angle of the average direction of the diverting force with the infeed path; and/or the angle between the infeed path and the outfeed path at the infeed exit and the outfeed entry, are adjustable and/or are determined in function of one or more of the following parameters:

type of the articles;

thickness of the articles;

operating speed;

a desired impact zone on which the fluid jet impacts the articles.

4. The apparatus according to claim 1, wherein the apparatus is configured such that one or more of the following settings of the apparatus:

the distance traveled by the fluid jet from the diverter to the article;

the fluid pressure of the fluid jet;

the flow rate of the fluid jet; and/or the timing and/or duration of the fluid jet, are determined by the function of one or more of the following parameters:

type of the articles;

thickness of the articles;

operating speed; and/or a desired impact zone on which the fluid jet impacts the articles.

5. The apparatus according to claim 1, wherein the apparatus comprises a guide assembly comprising a guide surface arranged at the infeed exit of the infeed conveyor and/or the outfeed entry of the outfeed conveyor, wherein the guide surface is configured, when at least a part of the article is diverted by the fluid jet, to guide the side of the article facing away from the fluid jet during at least part of the transition from the infeed path to the outfeed path, thereby determining a predetermined maximum distance traveled by the fluid jet along the average direction of the diverting force of the fluid jet.

6. The apparatus according to claim 5, wherein the infeed conveyor and outfeed conveyor comprise a common pulley arranged at the infeed exit and the outfeed entry, the guide assembly comprising the common pulley which determines the guide surface.

7. The apparatus according to claim 6, wherein the diverter is configured such that the average direction of the diverting force of the fluid jet intersects with the common pulley.

8. The apparatus according to claim 6, wherein the diverter is configured such that the average direction of the diverting force of the fluid jet intersects with an angular section of pulley between the tangent with the direction of the infeed path at the infeed exit and the tangent with the direction of the outfeed path at the outfeed entry, the guide surface determined by at least a part of the angular section.

9. The apparatus according to claim 1, wherein the apparatus further comprises:

at least one sensor configured to determine at least one infeed parameter related to the shape and/or state of the article in the infeed conveyor; and/or at least one sensor configured to determine at least one outfeed parameter related to the shape and/or state of the article in the outfeed conveyor; and a controller suitably coupled to said at least one sensor configured to determine at least one infeed parameter and/or coupled to said at least one sensor configured to determine at least one outfeed parameter, and said controller configured to control said apparatus in function of:

at least one desired infeed parameter and/or at least one desired outfeed parameter; and/or a desired ratio of at least one desired outfeed parameter with respect to at least one desired infeed parameter.

10. The apparatus according to claim 9, wherein:

said at least one sensor comprises one or more of the following:

an optical sensor;

an image sensor;

a camera;

a three-dimensional camera;

a distance sensor;

a thickness sensor;

a length sensor;

an edge detection sensor; and/or said at least one infeed parameter and/or outfeed parameter comprises one or more of the following:

the thickness of the article in its respective state in the infeed conveyor and/or outfeed conveyor;

the length of the article in its respective state in the infeed conveyor and/or outfeed conveyor;

the position of and/or distance between the upstream end and downstream end of the article in its respective state in the infeed conveyor and/or outfeed conveyor;

the position of the article along and/or with respect to the infeed path and/or the outfeed path in its respective state in the infeed conveyor and/or outfeed conveyor.

11. The apparatus according to claim 9, in which the controller is configured to control said apparatus in function of said at least one desired infeed parameters, outfeed parameters, and/or desired ratio, in such a way that:

the distance between opposing conveyor belts of the infeed conveyor and/or outfeed conveyor is adapted in function of the thickness of the article in its respective state in the infeed conveyor and/or outfeed conveyor, where the infeed conveyor and/or outfeed conveyor comprises opposing conveyor belts along the infeed path and/or the outfeed path in between which the article is conveyed; and/or the timing, duration, flow rate, pressure, width, and/or length of the fluid jet emitted by the diverter is adapted in function of:

the thickness of the article in its respective state in the infeed conveyor and/or the outfeed conveyor;

the length of the article in its respective state in the infeed conveyor and/or the outfeed conveyor;

the position of and/or distance between the upstream end and the downstream end of the article in its respective state in the infeed conveyor and/or outfeed conveyor; and/or the position of the article along and/or with respect to the infeed path and/or the outfeed path in its respective state in the infeed conveyor and/or outfeed conveyor.

12. The apparatus according to claim 1, wherein the apparatus is configured to controllably perform one or more of the following operations on the article by controlling the timing and/or duration of the fluid jet emitted by the diverter in function of the position of the article along and/or with respect to the infeed path and/or the outfeed path:

unfolded diversion: when a zone of the article comprising the upstream end of the article in its state in the infeed conveyor is impacted by the fluid jet;

folded diversion: when a zone of the article downstream of the upstream end of the article in its state in the infeed conveyor is impacted by the fluid jet and the upstream end of the article is not impacted by the fluid jet;

reversing diversion: when only a zone comprising the downstream end of the article in its state in the infeed conveyor is impacted by the fluid jet, such that the downstream end is inserted into the outfeed entry of the outfeed conveyor as the upstream end of the article in its state in the outfeed conveyor;

no diversion: when the article is not impacted by the fluid jet such that the article continues along the infeed path from the infeed exit past the outfeed entry without entering the outfeed entry.

13. The apparatus according to claim 1, wherein the brake assembly comprises a braking pulley determining at least part of the braking surface.

14. A method of operating an apparatus for diverting and/or folding articles according to claim 1, wherein the method comprises the steps of:

the infeed conveyor conveying the articles along an infeed path towards an infeed exit, where the articles can exit the infeed path to an outfeed entry of an outfeed conveyor;

the outfeed conveyor conveying the articles along an outfeed path from the outfeed entry, where articles can enter the outfeed path from the infeed exit of the infeed conveyor;

the diverter diverting an article from the infeed path to the outfeed entry of the outfeed conveyor by emitting a fluid jet to exhibit a diverting force on an impact zone of the article at a side of the article facing away from the outfeed entry at the infeed exit of the infeed conveyor.

15. An apparatus for diverting and/or folding articles comprising an infeed conveyor, an outfeed conveyor, and a diverter, wherein:

the infeed conveyor is configured to convey articles along an infeed path towards an infeed exit, where the articles can exit the infeed path to an outfeed entry of an outfeed conveyor;

the outfeed conveyor is configured to convey the articles along an outfeed path from the outfeed entry, where articles can enter the outfeed path from the infeed exit of the infeed conveyor;

the infeed conveyor and outfeed conveyor are configured such that:

an angle between the infeed path and the outfeed path at the infeed exit and the outfeed entry is in the range of 30° up to and including 150°; and the outfeed entry is positioned adjacent to the infeed path, such that articles can continue along the infeed path downstream of the infeed exit without entering the outfeed entry;

the diverter is configured to divert an article from the infeed path to the outfeed entry of the outfeed conveyor by exhibiting a diverting force on an impact zone of the article at the infeed exit of the infeed conveyor, wherein the diverter is a non-contact, fluid emitting diverter, configured to emit a fluid jet to exhibit the diverting force on the impact zone of the article at a side of the article facing away from the outfeed entry, and a guide assembly comprising a guide surface arranged at the infeed exit of the infeed conveyor and/or the outfeed entry of the outfeed conveyor, wherein the guide surface is configured, when at least a part of the article is diverted by the fluid jet, to guide the side of the article facing away from the fluid jet during at least part of the transition from the infeed path to the outfeed path, thereby determining a predetermined maximum distance traveled by the fluid jet along the average direction of the diverting force of the fluid jet, and wherein the infeed conveyor and outfeed conveyor comprise a common pulley arranged at the infeed exit and the outfeed entry, the guide assembly comprising the common pulley which determines the guide surface.

16. The apparatus according to claim 15, wherein the diverter is configured such that the average direction of the diverting force of the fluid jet intersects with the common pulley.

17. The apparatus according to claim 15, wherein the diverter is configured such that the average direction of the diverting force of the fluid jet intersects with an angular section of pulley between the tangent with the direction of the infeed path at the infeed exit and the tangent with the direction of the outfeed path at the outfeed entry, the guide surface determined by at least a part of the angular section.

18. The apparatus according to claim 15, wherein the brake assembly comprises a braking pulley determining at least part of the braking surface.

19. The apparatus according to claim 15, wherein the apparatus further comprises:

at least one sensor configured to determine at least one infeed parameter related to the shape and/or state of the article in the infeed conveyor; and/or at least one sensor configured to determine at least one outfeed parameter related to the shape and/or state of the article in the outfeed conveyor; and a controller suitably coupled to said at least one sensor configured to determine at least one infeed parameter and/or coupled to said at least one sensor configured to determine at least one outfeed parameter, and said controller configured to control said apparatus in function of:

at least one desired infeed parameter and/or at least one desired outfeed parameter; and/or a desired ratio of at least one desired outfeed parameter with respect to at least one desired infeed parameter.

20. The apparatus according to claim 19, wherein:

said at least one sensor comprises one or more of the following:

an optical sensor;

an image sensor;

a camera;

a three-dimensional camera;

a distance sensor;

a thickness sensor;

a length sensor;

an edge detection sensor; and/or said at least one infeed parameter and/or outfeed parameter comprises one or more of the following:

the thickness of the article in its respective state in the infeed conveyor and/or outfeed conveyor;

the length of the article in its respective state in the infeed conveyor and/or outfeed conveyor;

the position of and/or distance between the upstream end and downstream end of the article in its respective state in the infeed conveyor and/or outfeed conveyor;

the position of the article along and/or with respect to the infeed path and/or the outfeed path in its respective state in the infeed conveyor and/or outfeed conveyor.

* * * * *